US008303200B2

(12) United States Patent
Yokoyama et al.

(10) Patent No.: US 8,303,200 B2
(45) Date of Patent: Nov. 6, 2012

(54) PRINTER WITH MOVABLE BLADE HAVING RACK THAT MESHES WITH PINION WHEN COVER IS CLOSED

(75) Inventors: Yasumi Yokoyama, Chiba (JP); Mitsuhiro Kaiya, Chiba (JP); Shinji Nureki, Chiba (JP)

(73) Assignee: Seiko Instruments Inc. (JP)

( * ) Notice: Subject to any disclaimer, the term of this patent is extended or adjusted under 35 U.S.C. 154(b) by 522 days.

(21) Appl. No.: 12/587,345

(22) Filed: Oct. 6, 2009

(65) Prior Publication Data

US 2010/0086341 A1 Apr. 8, 2010

(30) Foreign Application Priority Data

Oct. 7, 2008 (JP) ..... 2008-260340

(51) Int. Cl.
*B41J 11/70* (2006.01)
*B41J 29/13* (2006.01)
*B26D 1/08* (2006.01)

(52) U.S. Cl. ..... 400/621; 400/693; 83/629

(58) Field of Classification Search ..... 400/621, 400/693; 83/613, 694, 603, 629
See application file for complete search history.

(56) References Cited

U.S. PATENT DOCUMENTS

| | | | | |
|---|---|---|---|---|
| 5,505,552 | A | 4/1996 | Hasegawa et al. | 400/621 |
| 7,059,793 | B2 * | 6/2006 | Mori et al. | 400/621 |
| 7,857,534 | B2 * | 12/2010 | Watanabe et al. | 400/621 |
| 2007/0119317 | A1 * | 5/2007 | Takagi | 101/227 |
| 2009/0317163 | A1 * | 12/2009 | Kohira et al. | 400/621 |

FOREIGN PATENT DOCUMENTS

| | | | |
|---|---|---|---|
| EP | 1785279 | | 5/2007 |
| EP | 1790486 | | 5/2007 |
| EP | 1955833 | | 8/2008 |
| JP | 2001001588 | A * | 1/2001 |
| JP | 2003127088 | A * | 5/2003 |
| JP | 2008100530 | | 5/2008 |
| JP | 2008100530 | A * | 5/2008 |

* cited by examiner

*Primary Examiner* — Daniel J Colilla
(74) *Attorney, Agent, or Firm* — Adams & Wilks

(57) ABSTRACT

A thermal printer with enhanced cutting performance includes a thermal head for performing printing on successively supplied recording sheets, and a platen roller for feeding the recording sheets. A cutter for cutting the recording sheets has a fixed blade and a movable blade. A main body unit supports the fixed blade, and a cover unit supports the movable blade and is removable with respect to the main body unit. A pinion gear meshes with a rack constructed integrally with the movable blade to move the movable blade. The main body unit supports the pinion gear, and the cover unit supports only the movable blade and the platen roller.

18 Claims, 20 Drawing Sheets

PRINTER WITH MOVABLE BLADE HAVING RACK THAT MESHES WITH PINION WHEN COVER IS CLOSED

BACKGROUND OF THE INVENTION

1. Field of the Invention

The present invention relates to a printer.

2. Description of the Related Art

Various types of thermal printers that perform printing by pressing a thermal head against a thermal recording sheet and emit color by heating are currently provided. In particular, the thermal printers are suitably used for printing various types of labels, receipts, tickets, and the like because printing of smooth characters and colorful graphic printing can be realized without using toner, ink, and the like.

As represented by a thermal printer, various printers with a cutter for cutting the printed recording sheet, are known. The cutter (auto cutter) including a drive source is normally set to automatically cut the recording sheet when the printing is completed, and hence the cut recording sheet can be rapidly used as receipt, ticket, and the like.

The thermal printer is used while being incorporated in a cash register, portable terminal device, and the like.

The thermal printer includes a casing provided with a housing unit for a roll-type recording sheet (roll sheet), and an open/close door of the roll sheet housing unit. A casing is mounted with a main body unit, and the open/close door is mounted with a cover unit. The main body unit supports a thermal head and the cover unit supports a platen roller for feeding the roll sheet. The thermal printer also includes a platen drive system for rotatably driving the platen roller.

The cutter includes a fixed blade, and a movable blade that linearly moves so as to approach to or separate from the fixed blade. For instance, the fixed blade is supported by the main body unit, and the movable blade is supported by the cover unit. When cutting the recording sheet, the recording sheet is sandwiched and cut with both blades like with scissors by moving the movable blade toward the fixed blade.

The thermal printer also includes a movable blade drive system for moving the movable blade. The movable blade drive systems adopting a rack-pinion type, a cam type, or the like are known. The movable blade drive system adopting the rack-pinion type includes a rack constructed integrally with the movable blade, a pinion gear that meshes with the rack, and a pinion drive system for driving the pinion gear.

Patent Document JP 2001-121764 A describes a printer in which the movable blade drive system is mounted on the cover unit. In the invention of Patent Document JP 2001-121764 A, the weight load applies on the hinge portion of the open/close door because the cover unit becomes heavy, and may be detrimental to the opening/closing operation of the open/close door due to change over time. Further, the electrical wiring of the movable blade drive system is formed on the main body side, and hence the wiring may break in accordance with the opening/closing of the cover. The drive system may break down due to vibration and impact in opening and closing.

Patent Document 2 describes a printer in which part of the movable blade drive system is mounted on the cover unit. FIG. 8B is a schematic configuration diagram of the printer described in Patent Document JP 2004-237555 A. In this printer, at least a rack 44 and a pinion gear 42 of the movable blade drive system are mounted to a cover unit 3. This printer has a driving wheel train mechanism mounted to the cover unit that is subjected to vibration and impact in opening and closing, and thus may break down.

In both inventions of Patent Documents 1 and 2, an acting point for moving the movable blade is at a backward position of the movable blade (movable blade push-out method). In this case, a large rotational moment acts on the cover unit due to a sheet cutting reaction force that acts from the fixed blade to the movable blade and a frictional force between the fixed blade and the movable blade. Due to such rotational moment, bite occurs in a direction the fixed blade and the movable blade open, the pressure between the fixed blade and the movable blade lowers, and the cutting operation becomes unstable. As a result, the cutting performance lowers.

SUMMARY OF THE INVENTION

In view of the above-mentioned problem, it is an object of the present invention to provide a printer in which the cutting performance with respect to the recording sheet is enhanced.

In order to solve the above-mentioned problem, a printer according to the present invention is provided with: a main body unit which supports one of a thermal head and a platen roller and one of a movable blade constructed integrally with a rack and a fixed blade; a cover unit which supports another of the thermal head and the platen roller and another of the movable blade and the fixed blade, which are not supported by the main body unit; and a movable blade drive mechanism for driving the movable blade and a platen drive mechanism for driving the platen roller, wherein: a pinion gear rotated by the movable blade drive mechanism is provided on a unit different from the unit supporting the movable blade; the cover unit is provided to be freely openable/closable with respect to the main body unit; and, when the cover unit is closed with respect to the main body unit, the pinion gear meshes with the rack and reciprocates the movable blade so that the movable blade and the fixed blade cooperate to cut a recording sheet at a predetermined position.

According to such configuration, the fixed blade and the pinion gear are proximally arranged in the arrangement unit of the fixed blade, and hence the movable blade is pulled in toward the fixed blade by the pinion gear when cutting the recording sheet (pull-in method). In this case, the driving force from the pinion gear to the movable blade and the reaction force from the fixed blade to the movable blade act in close proximity in horizontally opposite directions, and thus the rotational moment that acts on the arrangement unit of the movable blade becomes small. The lowering in pressure between the fixed blade and the movable blade thus can be reduced, and the cutting operation can be stabilized so that the cutting performance can be enhanced. Lighter weight is achieved because the arrangement unit of the movable blade only supports the platen roller or the thermal head other in addition to the movable blade. Thus, the weight load in opening and closing the cover unit with respect to the main body unit can be alleviated.

Further, a printer comprises: a main body unit which supports a thermal head and a fixed blade; a cover unit which supports a platen roller and a movable blade constructed integrally with a rack; and a movable blade drive mechanism for driving the movable blade and a platen drive mechanism for driving the platen roller which are provided in the main body unit; wherein: a pinion gear rotated by the movable blade drive mechanism is provided in the main body unit; the cover unit is provided to be freely openable/closable with respect to the main body unit; and, when the cover unit is closed with respect to the main body unit, the pinion gear meshes with the rack and reciprocates the movable blade so that the movable blade and the fixed blade cooperate to cut a recording sheet at a predetermined position.

In a structure in which the platen roller and the movable blade constructed integrally with the rack are supported by the cover unit, the drive mechanism of the gear train and the like, as well as electrical components such as the thermal head and the drive source are not arranged on the cover unit that opens and closes with respect to the main body unit. Thus mechanical and electrical break down due to impact and vibration in opening and closing the cover unit can be significantly reduced.

Further, it is desirable that the printer further comprise a pinion gear release mechanism for enabling the pinion gear to freely rotate.

Further, it is desirable that the pinion gear comprises a pair of pinion gears respectively provided on left and right with respect to one axis, the rack constructed integrally with the movable blade arranged on the cover unit mesh with the pinion gear on the movable blade drive mechanism side and then mesh with the another pinion gear, and thereafter, the pinion gear on the movable blade drive mechanism side and the movable blade drive mechanism mesh with each other when the cover unit is closed with respect to the main body unit.

Further, it is desirable that the rack and the pinion gear have tooth shapes in which tooth tops mesh with each other without locking when shifting the cover unit from an opened state to a closed state with respect to the main body unit.

Further, it is desirable that the rack comprise with a claw for rotating the pinion gear before the pinion gear meshes with the rack when shifting the cover unit from the opened state to the closed state with respect to the main body unit.

According to such configuration, the rack and the pinion gear can be smoothly meshed when shifting the cover unit from the opened state to the closed state with respect to the main body unit.

The movable blade may be provided with a plurality of holes that engage the pinion gear in place of the rack.

Further, it is desirable that the rack comprise a regulation member for regulating the rack not to be detached from the pinion gear, and the regulation member is supported by an arrangement unit of the fixed blade.

According to such configuration, the fixed blade and the regulation member are proximally arranged in the arrangement unit of the fixed blade. In this case, the regulation force from the regulation member to the movable blade and the pressure contacting force from the fixed blade to the movable blade act in close proximity in vertically opposite directions, and thus the rotational moment that acts on the arrangement unit of the movable blade becomes small. The lowering in pressure between the fixed blade and the movable blade thus can be reduced, and the cutting operation can be stabilized so that the cutting performance can be enhanced.

Further, the rack may comprise a regulation member for regulating the rack not to be detached from the pinion gear, and the regulation member may be supported by an arrangement unit of the movable blade.

According to such configuration, the movement of the movable blade in the vertical direction can be regulated by the regulation member by simply closing the cover unit with respect to the main body unit. Therefore, a switching mechanism for regulating or deregulating the movement of the movable blade in the vertical direction is unnecessary, and the manufacturing cost can be reduced.

Further, it is desirable that the rack comprise a regulation member for regulating the rack not to be detached from the pinion gear, and the regulation member be arranged on the fixed blade side with respect to a rotation shaft of the platen roller.

According to such configuration, the regulation member is proximally arranged to the fixed blade, and hence the rack is effectively prevented from being detached from the pinion gear by the pressure contacting force from the fixed blade to the movable blade.

Further, it is desirable that the movable blade be removable with respect to the supporting unit so as to be replaceable.

According to such configuration, only the platen roller and the movable blade are arranged on the cover unit, and hence only the movable blade can be easily replaced without dissembling the movable blade drive mechanism.

According to the thermal printer of the present invention, the rotational moment that acts on the arrangement unit of the movable blade becomes small because the movable blade is pulled in toward the fixed blade by the pinion gear when cutting the recording sheet. The lowering in pressure between the fixed blade and the movable blade thus can be reduced, and the cutting operation can be stabilized so that the cutting performance can be enhanced.

BRIEF DESCRIPTION OF THE DRAWINGS

In the accompanying drawings:

FIG. 8A illustrates a case of the pull-in method of the embodiment and FIG. 8B illustrates a case of the push-out method of the related art;

FIG. 9A illustrates a case of the pull-in method of the embodiment and FIG. 9B illustrates a case of the push-out method of the related art;

DETAILED DESCRIPTION OF THE PREFERRED EMBODIMENT INVENTION

An embodiment of the present invention is described below with reference to the accompanying drawings.

(Thermal Printer)

Figure 1:
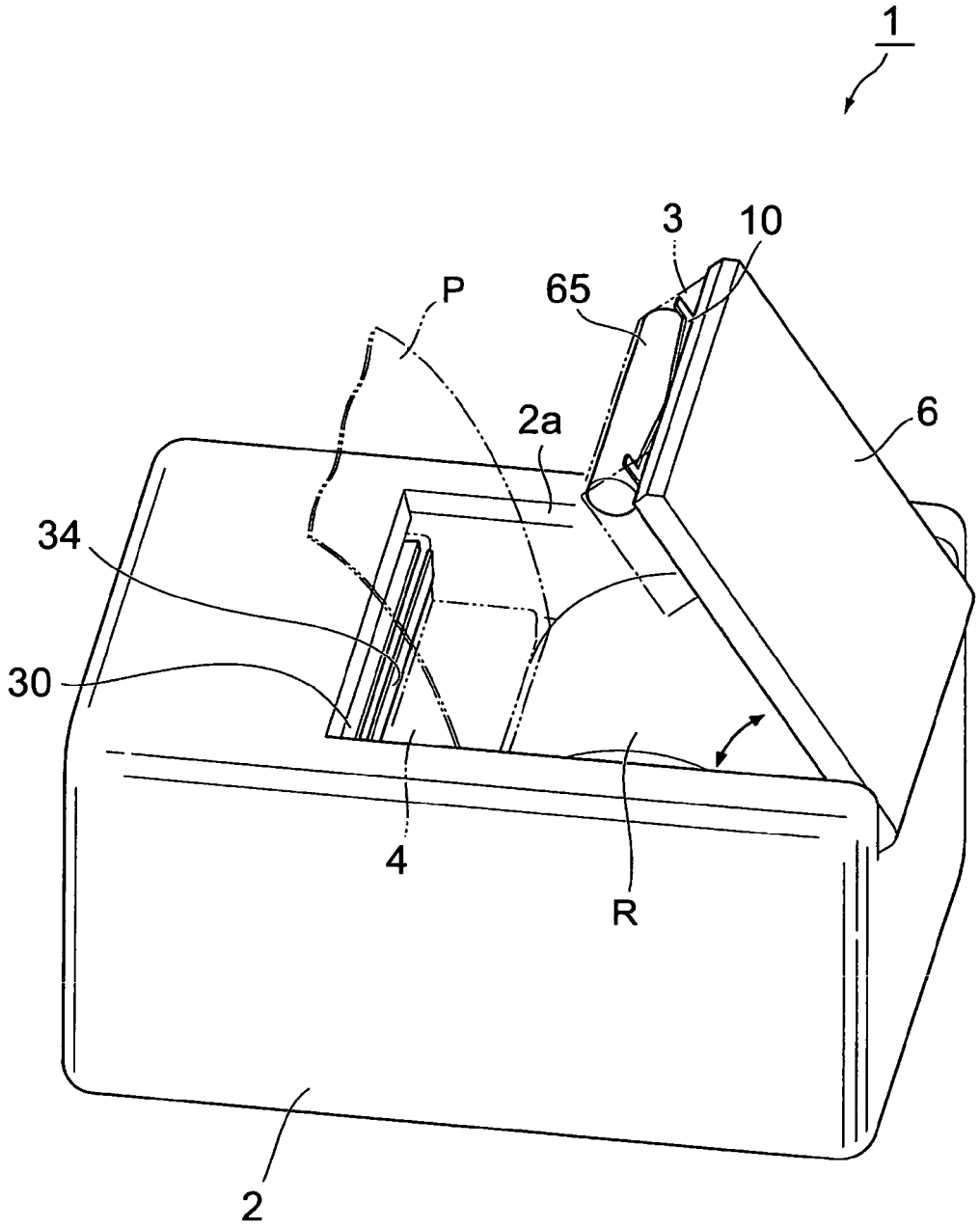
FIG. 1 is a perspective view of an outer appearance of a thermal printer.
Figure 2:
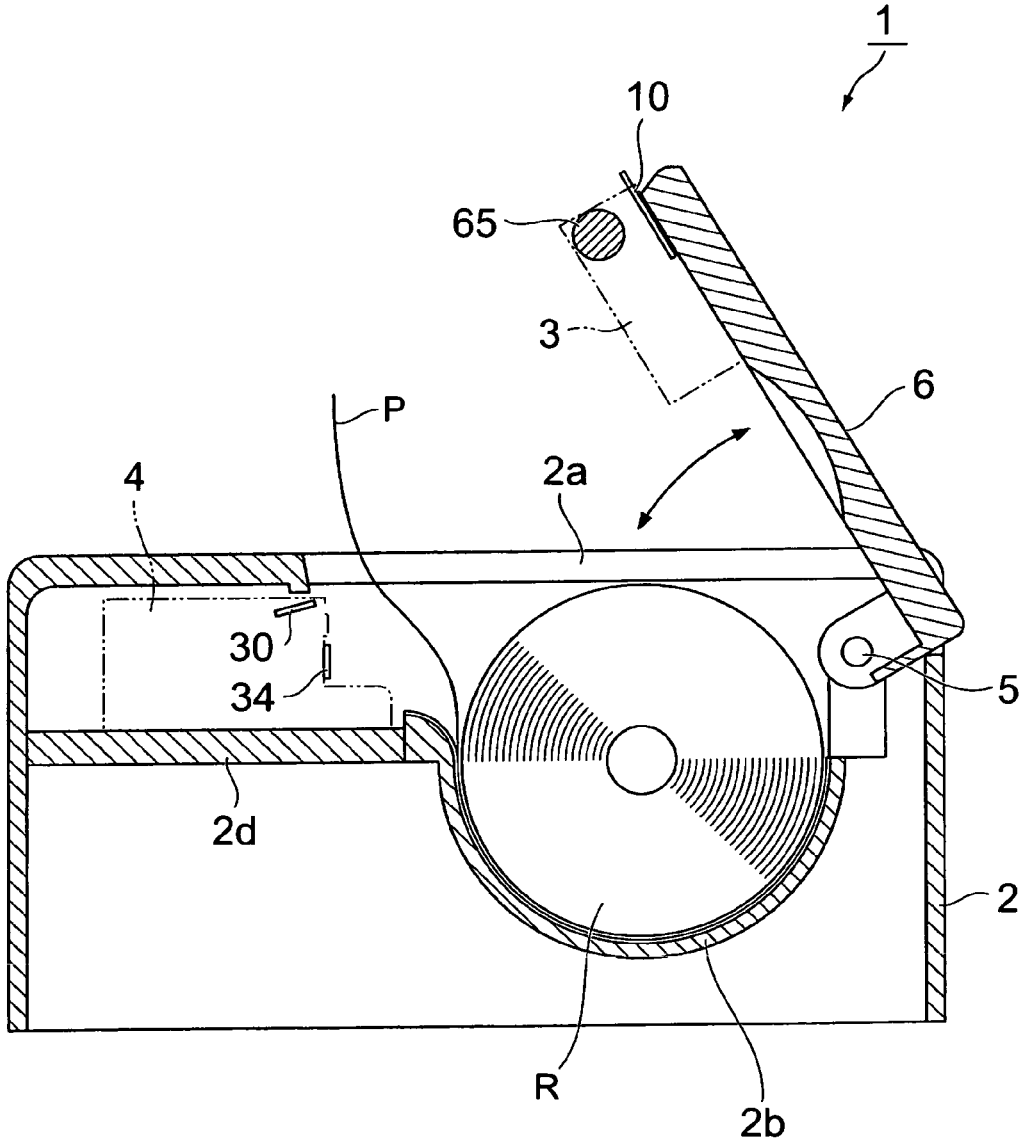
FIG. 2 is a side cross-sectional view of a state in which an open/close door of the thermal printer is opened.
Figure 3:
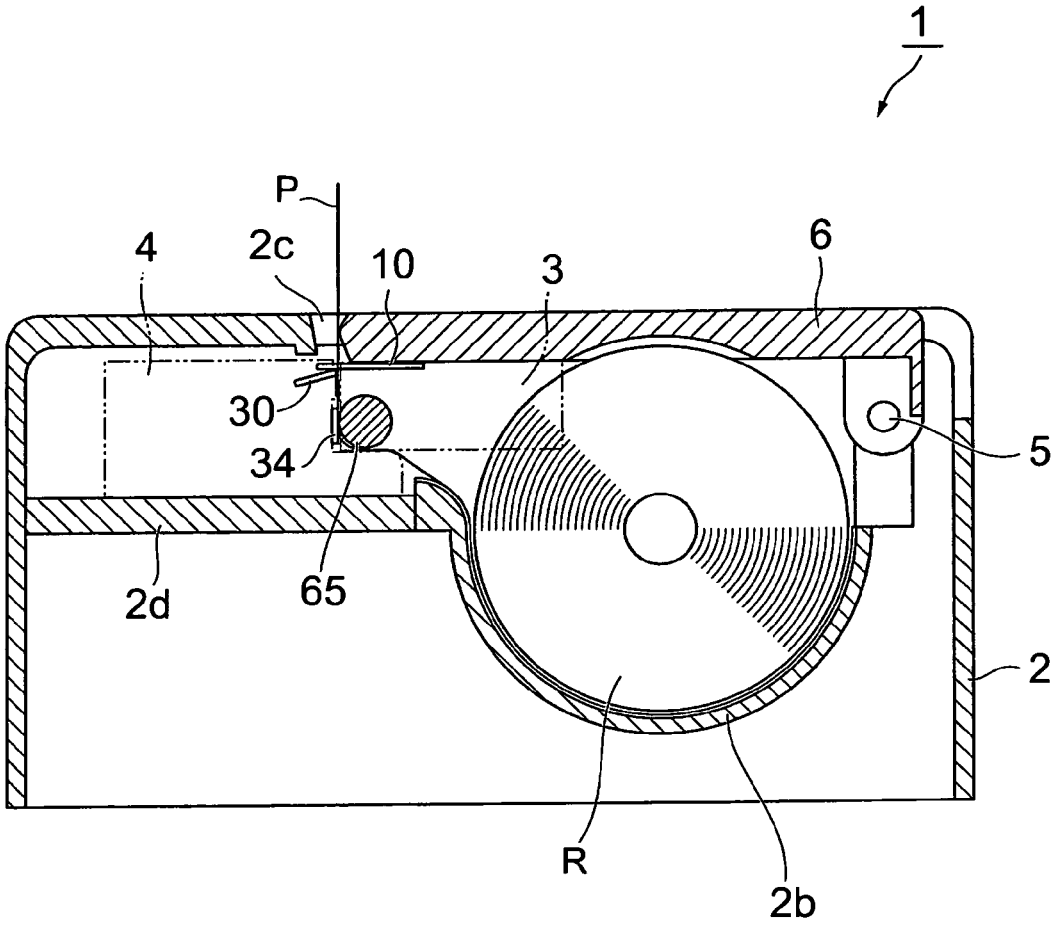
FIG. 3 is a side cross-sectional view of a state in which the open/close door of the thermal printer is closed.

FIG. 1 is a perspective view of an outer appearance of a thermal printer, FIG. 2 is a side cross-sectional view of a state in which an open/close door is opened, and FIG. 3 is a side cross-sectional view of a state in which the open/close door is closed. In this embodiment, the upper and lower direction in the plane of drawing of FIG. 2 and FIG. 3 is referred to as "vertical direction" (upper side in the plane of drawing is referred to as "upper" and the lower side in the plane of drawing is referred to as "lower"), and the left and right direction in the plane of drawing is referred to as "horizontal direction".

A thermal printer 1 of this embodiment is a printer that can appropriately cut, after performing printing on a recording sheet P, recording sheet P pulled out from a roll sheet R to use as a ticket, a receipt, and the like, and mainly includes a casing 2, a main body unit 4, an open/close door 6, and a cover unit 3, as illustrated in FIG. 1 and FIG. 2.

The casing 2 is a casing molded from plastic or a metal material, and is formed to a box-shape with an insertion port 2*a* opened at the upper surface. A roll sheet housing unit 2*b* for housing the roll sheet R inserted from the insertion port 2*a* is arranged in the interior of the casing 2. The housing unit 2*b* is formed to be curved in an arcuate shape, and enables the cylindrical roll sheet R to be stably mounted.

An open/close door 6 fixed in an openable/closable manner through an intermediation of a hinge portion 5 is attached to the upper surface of the casing 2. The open/close door 6 opens and closes within a range of a constant angle from an opened state illustrated in FIG. 2 to a closed state illustrated in FIG. 3. The insertion port 2*a* appears when the open/close door 6 is opened, and hence the roll sheet R can be inserted into or be taken out from the casing 2. A discharge port 2*c* is designed to be formed between the distal end of the open/close door 6 and the casing 2 when the open/close door 6 is closed. The recording sheet P is pulled out from the interior of the casing 2 through such a discharge port 2*c*.

Note that the open/close door 6 automatically locks with respect to the casing 2 when closed. The lock mechanism unlocks with one-touch from the outer side of the casing 2, and hence the open/close door 6 can be promptly opened.

The main body unit 4 is a unit mainly incorporating a fixed blade 30, a thermal head 34, to be hereinafter described, and a respective drive mechanism for driving a movable blade and a platen roller, and is provided in the casing 2, as illustrated in FIG. 1 to FIG. 3. In other words, an internal plate 2*d* is integrally formed with a roll sheet housing unit 2*b* of a casing 2, and the main body unit 4 is fixed on the internal plate 2*d*. Note that, in FIG. 1 to FIG. 3, the fixed blade 30 and the thermal head 34 are representatively illustrated.

The cover unit 3 is a unit mainly incorporating a movable blade 10 and a platen roller 65, to be hereinafter described, and is provided on an inner surface on a distal end side of the open/close door 6. Thus, the cover unit 3 moves with the opening/closing operation of the open/close door 6 to be coupled to the main body unit 4 or to be separated from the main body unit 4.

(Main Body Unit, Cover Unit)

Figure 4:
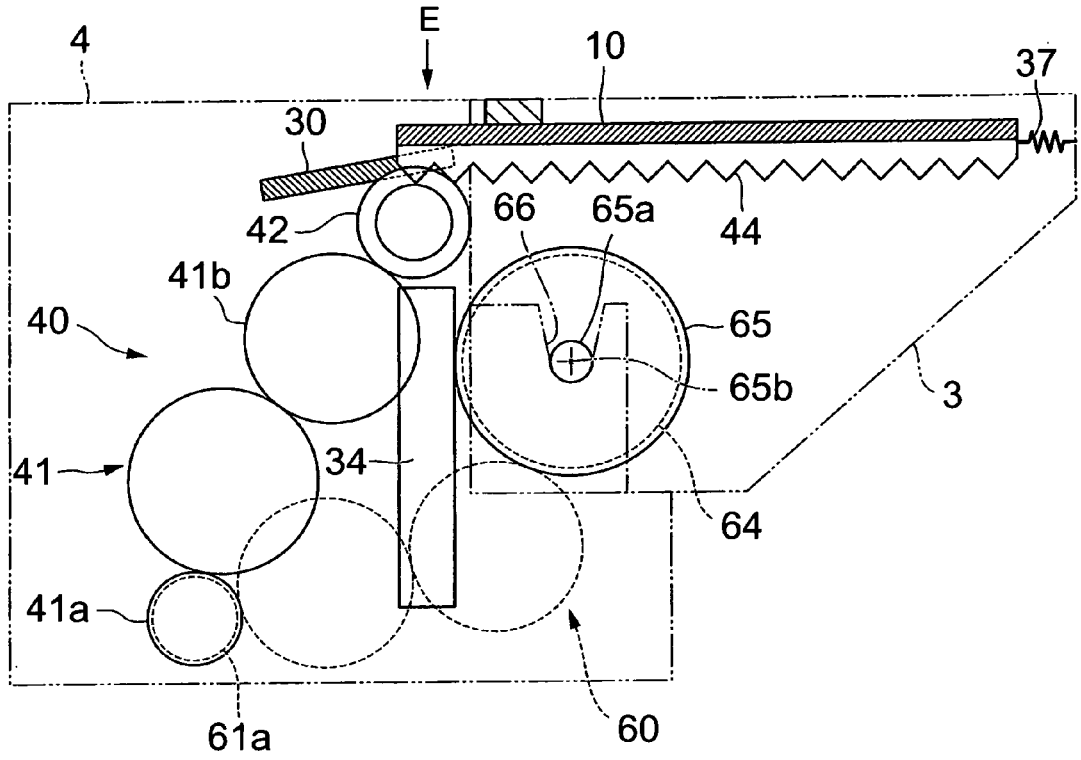
FIG. 4 is a schematic configuration view of a main body unit and a cover unit.

FIG. 4 is a schematic configuration diagram of the main body unit and the cover unit. The cover unit 3 includes the platen roller 65 made of an elastic body such as rubber for feeding the recording sheet P, and the movable blade 10 that linearly moves so as to approach or separate from the fixed blade 30.

The platen roller 65 is arranged to sandwich the recording sheet P with the thermal head 34 when the open/close door 6 is closed and the cover unit 3 and the main body unit 4 are coupled as illustrated in FIG. 3. The platen roller 65 rotates by the rotational force transmitted from the main body unit 4 side after closing the open/close door 6, and hence the recording sheet P pulled out from the roll sheet R can be fed out to the exterior of the casing 2 from a discharge port 2*c*.

Figure 5:
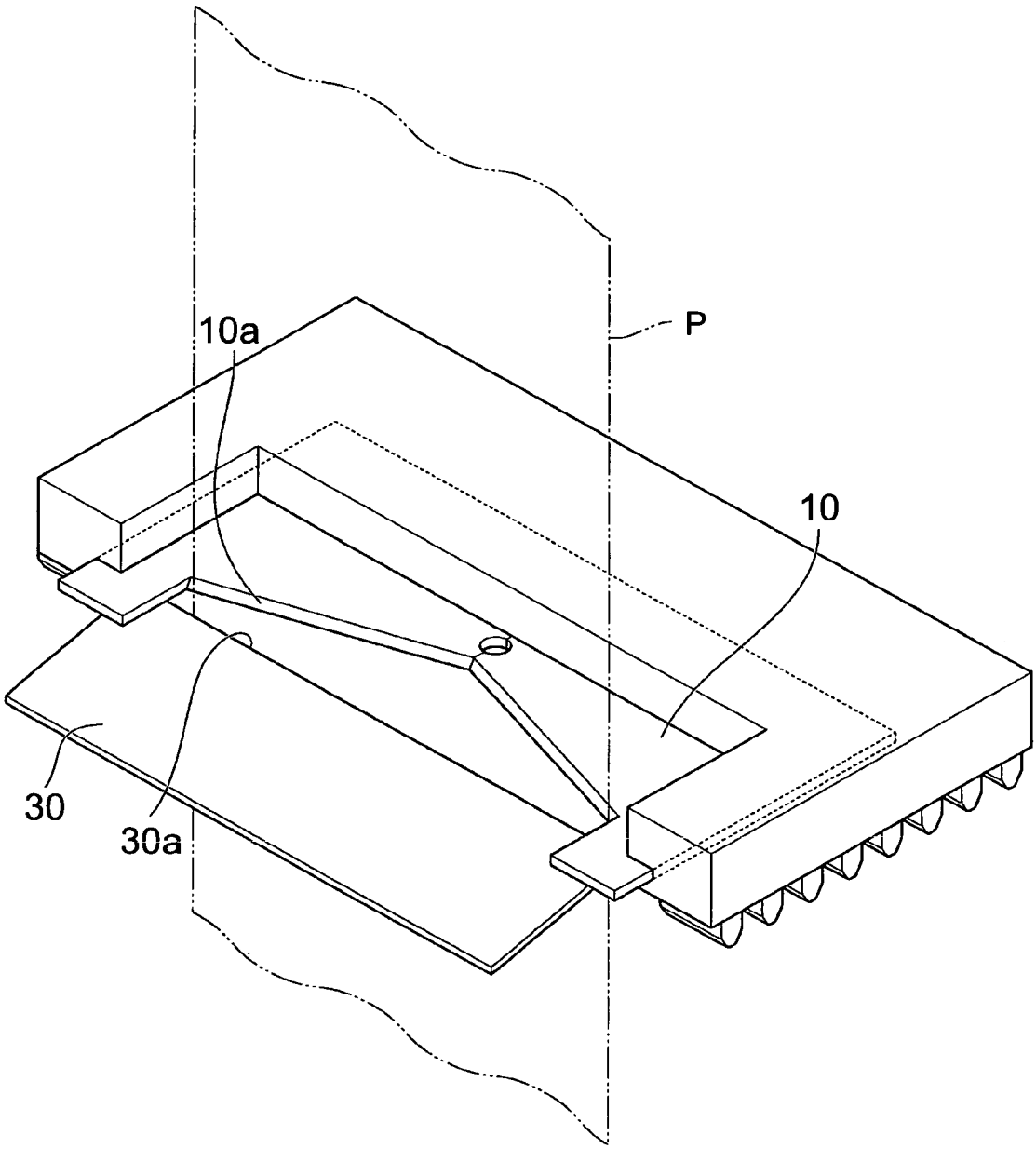
FIG. 5 is a perspective view of a fixed blade and a movable blade in printing.
Figure 6:
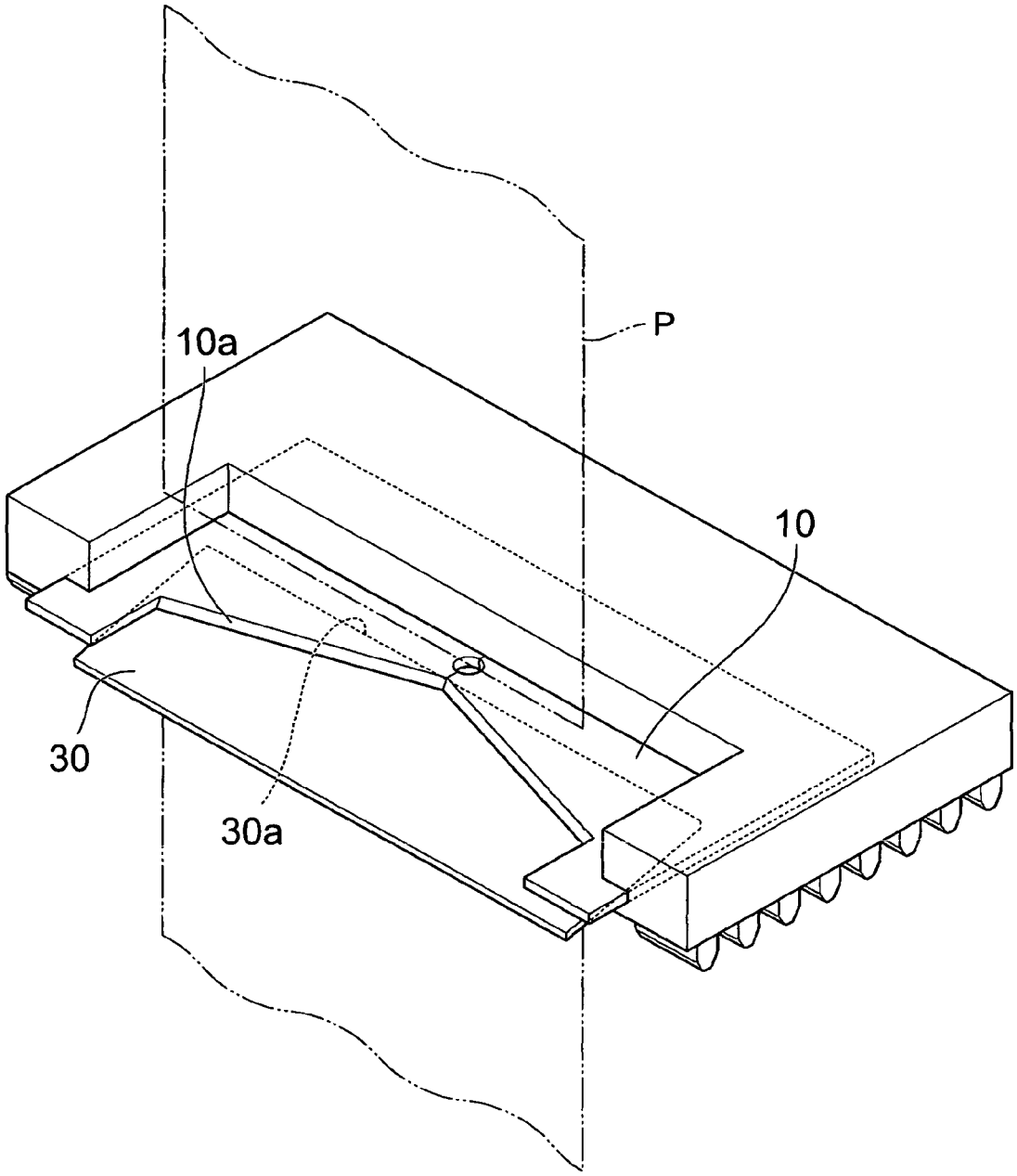
FIG. 6 is a perspective view of the fixed blade and the movable blade in cutting.

The movable blade 10 functions as a cutter in cooperation with the fixed blade 30, and is arranged to ride on the fixed blade 30 when the open/close door 6 is closed and the main body unit 4 and the cover unit 3 are coupled. As illustrated in FIG. 5, the movable blade 10 is a plate-shaped blade formed to a substantially V-shape in top view such that the length from a proximal end portion to a cutting edge 10*a* of a distal end portion gradually becomes shorter from both ends in a width direction toward the central part. When the movable blade 10 is slid toward the fixed blade 30, the recording sheet P is sandwiched and cut between the movable blade 10 and the fixed blade 30, as illustrated in FIG. 6. As illustrated in FIG. 4, blade 30 in the horizontal direction by an elastic body (coil spring) 37.

Returning back to FIG. 4, the main body unit 4 includes the fixed blade 30, one part of a movable blade drive system 40 for linearly moving the movable blade 10, a platen drive system 60 for rotatably driving the platen roller 65, and the thermal head 34 for performing printing on the pulled-out recording sheet P. The fixed blade 30 is a plate-shaped blade extending in the width direction of the recording sheet P. Note that the fixed blade 30 is biased toward the movable blade 10 on the upper side by a coil spring and the like (not shown) to stabilize the cutting operation.

The movable blade drive system 40 is arranged on the front side in the plane of drawing of FIG. 4, and includes a rack 44 integrally attached to the movable blade 10, a pinion gear 42 that meshes with the rack 44, and a pinion drive system 41 for rotatably driving the pinion gear 42. The pinion drive system 41 includes a gear train that meshes with the pinion gear 42, and a forward and reverse rotatable movable blade motor 41*a* that meshes with the gear train. Of the movable blade drive system 40, the rack 44 is constructed integrally with the movable blade 10 and is supported by the cover unit 3, but the pinion gear 42 and the pinion drive system 41 are supported by the main body unit 4.

The platen drive system 60 is arranged on the deep side in the plane of drawing of FIG. 4, and includes a driven wheel 64 arranged on a center axis of the platen roller 65, a gear train that meshes with the driven wheel, and a platen motor (feed motor) 61*a* that meshes with the gear train. Of the platen drive system 60, the gear train and the platen motor 61*a* other than the driven wheel 64 are supported by the main body unit 4.

In this embodiment, the movable blade drive system 40 is arranged on the front side in the plane of drawing of FIG. 4, and the platen drive system 60 is arranged on the deep side in the plane of drawing of FIG. 4, but may be respectively arranged on opposite sides or may be arranged on the same side.

As illustrated in FIG. 1, the thermal head 34 is formed to extend in the width direction of the recording sheet P and is arranged at a position facing the platen roller 65 when the open/close door 6 is closed. The thermal head 34 includes great number of heater elements (not shown), and is biased to the platen roller 65 side by a coil spring and the like (not shown). With this, the thermal head 34 is thus reliably pressed against the recording sheet P fed out by the platen roller 65, and satisfactory printing can be carried out.

As illustrated in FIG. 4, in the main body unit 4, there is formed a fit-in hole 66 to be fitted with a bearing 65*a* covered on a rotation shaft 65*b* of the platen roller 65 without space. An inclined portion for drawing the bearing 65*a* into the fit-in hole 66 is provided on the upper side of the fit-in hole 66. That is, when the open/close door 6 is closed, the bearing 65*a* of the platen roller 65 naturally fits into the fit-in hole 66. As a result, the main body unit 4 and the cover unit 3 are thereby coupled.

(Printing and Cutting Operations)

The printing and cutting operations of the above-mentioned thermal printer 1 are described below.

First, the roll sheet R is set. Specifically, as illustrated in FIG. 1 and FIG. 2, the roll sheet R is inserted into the casing 2 from an insertion port 2*a* with the open/close door 6 opened. In this case, the recording sheet P is pulled out to the outer side of the casing 2 in advance. When the open/close door 6 is closed, the bearing 65*a* of the platen roller 65 is fitted into the fit-in hole 66 of the main body unit 4, and a lock shaft (not shown) is fitted into a lock groove (not shown) on the main body unit 4 side and automatically locked. The main body unit 4 and the cover unit 3 are thereby coupled.

As illustrated in FIG. 3, the recording sheet P is sandwiched between the platen roller 65 and the thermal head 34, and is pulled out to the outer side of the casing 2 from the discharge port 2*c*.

Figure 19:
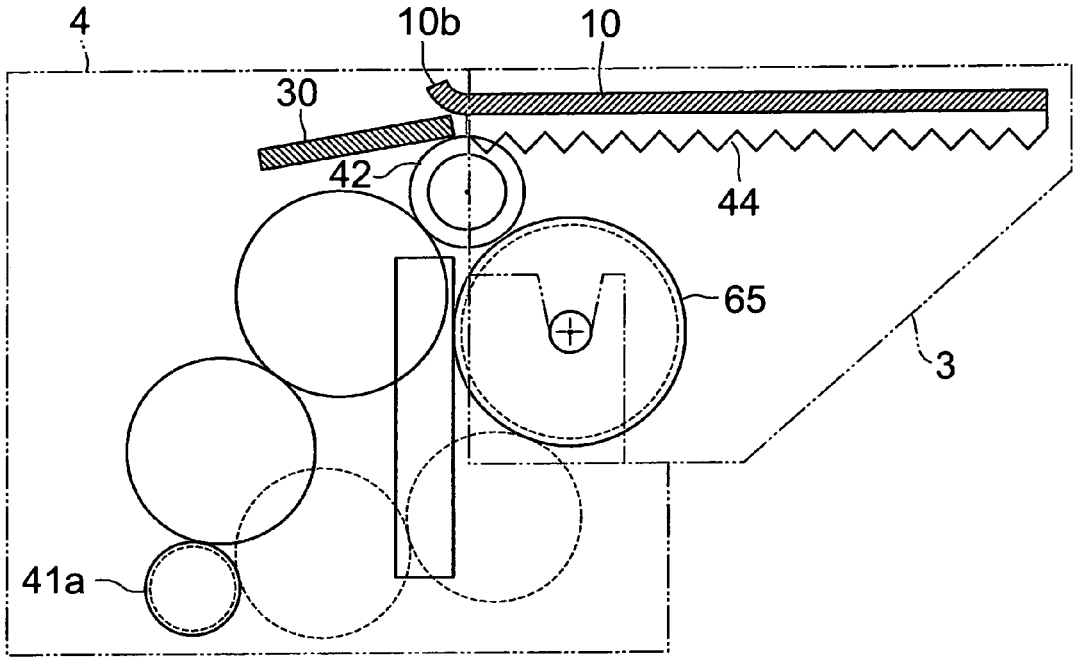
FIG. 19 is a schematic configuration view of when the pinion gear is arranged closer to the platen roller.
Figure 20:
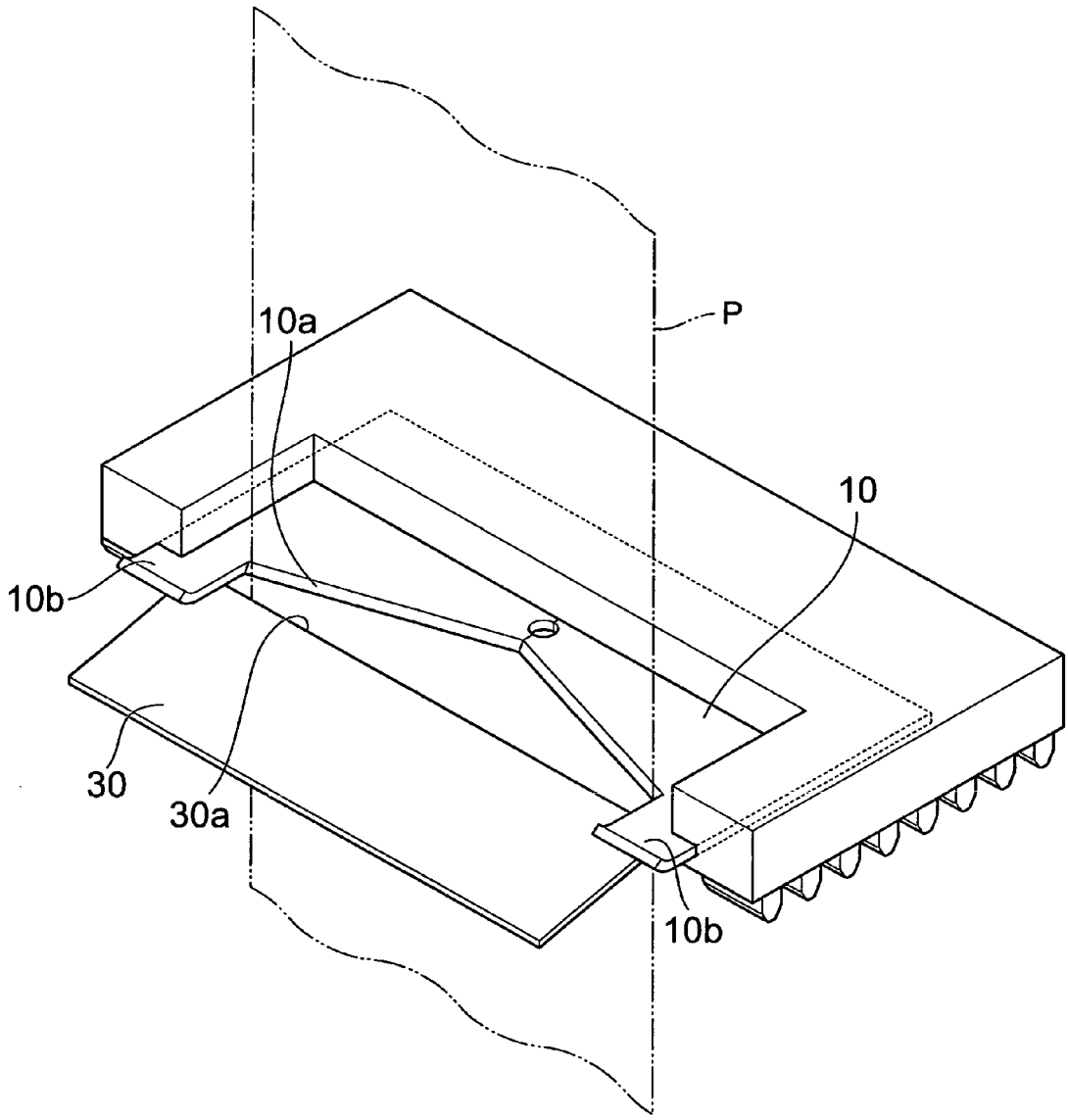
FIG. 20 is a perspective view of the fixed blade and the movable blade during printing.

The rack 44 and the pinion gear 42 illustrated in FIG. 4 are meshed when the open/close door 6 is closed. In this embodiment, the position of the pinion gear 42 is under the fixed blade 30, and hence the movable blade 30 overlays the fixed blade 30 from the beginning when the open/close door is closed. In this case, the manufacturing of the movable blade 10 is simplified because the distal end of the movable blade 10 does not need to be subjected to a bending process. In contrast, as illustrated in FIG. 19, in the configuration in which the position of the pinion gear 42 is arranged on the platen roller 65 side with respect to the fixed blade 30, the distal end of the movable blade 10 does not overlay the fixed blade 30 when the open/close door is closed. In this case, the distal end of the movable blade 10 needs to smoothly ride on the fixed blade 30 when the movable blade 10 is pulled in by the pinion gear 42. In this case, a bent shape 10*b* is desirably formed at the distal end of the movable blade 10 (see FIG. 20). The projections of both end portions of the movable blade 10 from the cover unit 3 thus can be reduced, which is suitable in designing the printer.

Then, various types of information are printed on the recording sheet P. First, as illustrated in FIG. 4, the platen motor 61*a* is driven, and the platen roller 65 is rotatably driven by way of the gear train and the driven wheel 64. As a result, as illustrated in FIG. 3, the recording sheet P sandwiched between the outer circumferential surface of the platen roller 65 and the thermal head 34 is pulled out from the roll sheet R housed in the housing unit 2*b*, and fed to the upper side of the casing 2.

The thermal head 34 is activated at the same time to have the great number of heater elements of the thermal head appropriately generate heat, whereby various types of characters, figures, and the like can be clearly printed on the fed recording sheet P. The printed recording sheet P is fed by the platen roller 65, and passed between the fixed blade 30 and the movable blade 10.

Then, the recording sheet P is cut. Specifically, the movable blade motor 41*a* illustrated in FIG. 4 is driven, and the pinion gear 42 is rotated through the gear train. The rack 44 meshed with the pinion gear 42 then linearly moves, the movable blade 10 constructed integrally with the rack slidably moves toward the fixed blade 30, and the respective cutting edges 10*a*, 30*a* overlap as illustrated in FIG. 6. As a result, the recording sheet P can be sandwiched and cut between the fixed blade 30 and the movable blade 10. After the cutting, the movable blade motor 41*a* illustrated in FIG. 4 is reverse rotated to return the movable blade 10 to the original position.

Here, description is made of the recovery operation of when the recording sheet P is bitten between the fixed blade 30 and the movable blade 10 and the movable blade 10 cannot be driven in the cutting direction nor the reverse direction with the movable blade motor 41*a*.

Figure 7A:
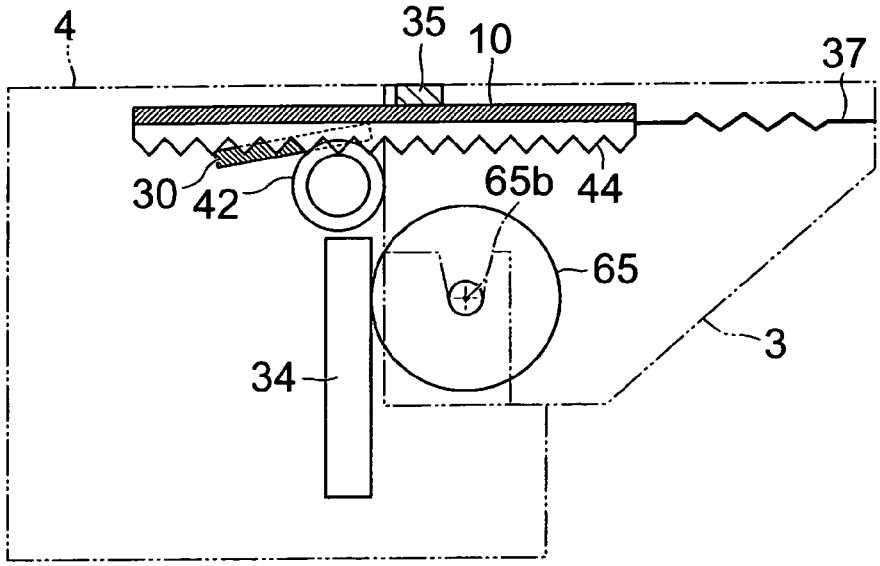
FIGS. 7A-7B are explanatory views of a recovery operation of when the recording sheet is bitten.
Figure 7B:
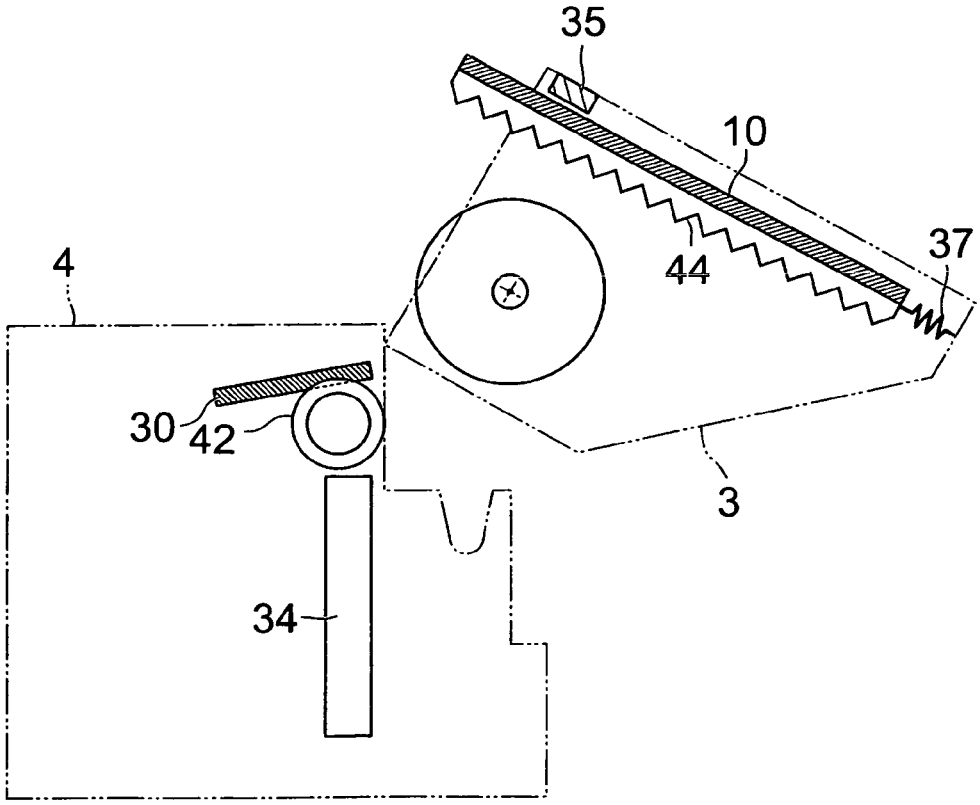

FIG. 7A illustrates a state in which the recording sheet is bitten between the fixed blade and the movable blade, and FIG. 7B is an explanatory view of the recovery operation. As illustrated in FIG. 7A, the recording sheet is sometimes bitten between the fixed blade 30 and the movable blade 10 while moving the movable blade 10 toward the fixed blade 30 side and cutting the recording sheet (not shown). If the biting force is large, the movable blade 10 cannot be pulled away from the fixed blade 30 even by reverse rotating the movable blade motor.

In this case, as illustrated in FIG. 7B, the open/close door is opened and the cover unit 3 is separated from the main body unit 4. As a result, the movable blade 10 separates from the fixed blade 30 in the vertical direction, and hence the recording sheet bitten between the blades can be removed. In this embodiment, the pinion gear 42 is supported by the main body unit 4, and hence the rack 44 separates from the pinion gear 42 along with the movable blade 10 when the open/close door is opened. The movable blade 10 thus becomes freely movable, and the movable blade 10 separates from the fixed blade 30 in the horizontal direction by the restoring force of the elastic body 37. As a result, the movable blade 10 returns to the home position.

(Pull-In Method and Push-Out Method)

Next, examination is made on the force that acts on the movable blade and the cover unit when cutting the recording sheet. Hereinafter, cases of the related art (push-out method) and this embodiment (pull-in method) are reviewed in order for the force in the horizontal direction and the force in the vertical direction.

(Horizontal Direction)

Figure 8A:
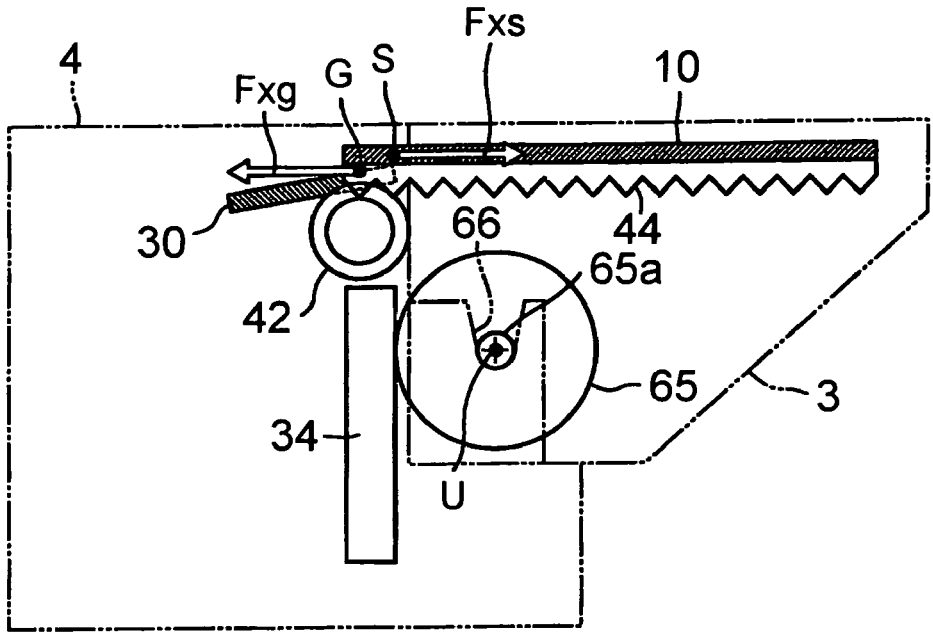
FIGS. 8A-8B are explanatory views of a force in a horizontal direction, which acts on the movable blade and the cover unit, where
Figure 8B:
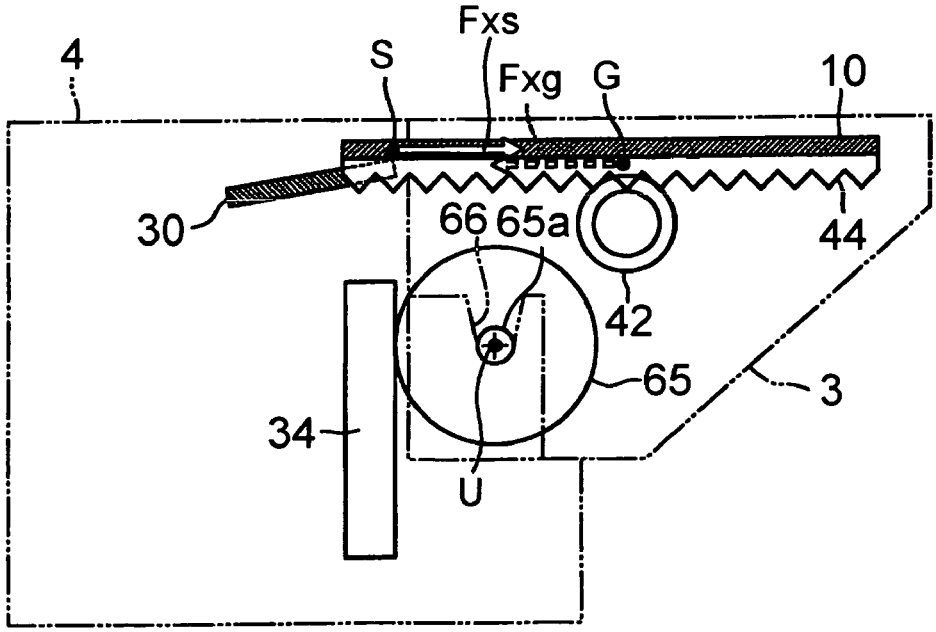
FIG. 8B PRIOR ART

FIG. 8 are explanatory views of the force in the horizontal direction that acts on the movable blade and the cover unit, where FIG. 8A is a case of this embodiment (pull-in method) and FIG. 8B is a case of the related art (push-out method).

In the conventional technique illustrated in FIG. 8B, the pinion gear 42 is supported by the cover unit 3. In this case, a gear meshing portion G of the rack 44 and the pinion gear 42 is arranged spaced apart from the fixed blade 30. Thus, when cutting the recording sheet, the movable blade 10 is pushed out toward the fixed blade 30 by the pinion gear 42 (push-out method).

In the push-out method illustrated in FIG. 8B, the force in the horizontal direction that acts on the movable blade 10 is examined. At the gear meshing portion G of the rack 44 and the pinion gear 42, the movable blade 10 receives the driving force Fxg from the pinion gear 42. Meanwhile, at a blade contacting portion S of the movable blade 10 and the fixed blade 30, the movable blade 10 receives a sheet cutting reaction force and a frictional force Fxs from the fixed blade 30.

In this case, the pinion gear 42 and the movable blade 10 integrated with the rack 44 are supported by the cover unit 3, and the cover unit 3 is connected to the main body unit 4 at a unit connecting portion U.

Thus, the force Fxs received by the cover unit 3 from the main body unit 4 at the blade contacting portion S acts as a rotational moment in the clockwise direction in the figure on the cover unit with the unit connecting portion U as the fulcrum. Since a slight play exists between the bottom surface of the cover unit 3 and the main body unit 4, the cover unit 3 slightly rotates in the clockwise direction with the unit connecting portion U as the center. As a result, the movable blade 10 separates from the fixed blade 30 in the vertical direction, whereby the pressure between the fixed blade 30 and the movable blade 10 lowers. Therefore, there is a problem that the cutting operation becomes unstable to deteriorate the cutting performance.

In contract, in this embodiment illustrated in FIG. 8A, the pinion gear 42 is supported by the main body unit 4. Further, the gear meshing portion G of the rack 44 and the pinion gear 42 is proximally arranged to the fixed blade 30. Thus, when cutting the recording sheet, the movable blade 10 is pulled in toward the fixed blade 30 by the pinion gear 42 (pull-in method).

In the pull-in method, the force in the horizontal direction that acts on the movable blade 10 is similar to the push-out method. The movable blade 10 receives the driving force Fxg from the pinion gear 42 at the gear meshing portion G, and the movable blade 10 receives the sheet cutting reaction force and the frictional force Fxs from the fixed blade 30 at the blade contacting portion S.

In this case, the pinion gear 42 is supported by the main body unit, and hence the force Fxg of pulling in the movable blade 10 and the sheet cutting reaction force and the frictional force Fxs from the fixed blade 30 to the movable blade 10 substantially cancel each other out, whereby the force and the rotational moment on the cover unit 3 do not act.

More specifically, since the movable blade 10 is connected to the cover unit with the elastic body 37, a force in the counterclockwise direction with the unit connecting portion U as the center acts on the cover unit, oppositely to the push-out method described above, but such force is a negligible force. Even if such force is acted, the force acts in a direction in which the movable blade 10 pressure contacts the fixed blade 30 in the vertical direction. As a result, the cutting operation of the cutter can be stabilized, and the cutting performance can be enhanced.

As described above, in this embodiment, the fixed blade 30 and the pinion gear 42 are proximally arranged in the main body unit 4, and the movable blade 10 is pulled in toward the fixed blade 30 by the pinion gear 42 when cutting the recording sheet (pull-in method). In this case, the lowering in pressure between the fixed blade 30 and the movable blade 10 of when cutting the recording sheet can be prevented, the cutting operation can be stabilized, and the cutting performance can be enhanced. Accompanied therewith, an inexpensive thin blade can be used for the movable blade 10 and the fixed blade 30.

(Vertical Direction)

Figure 9A:
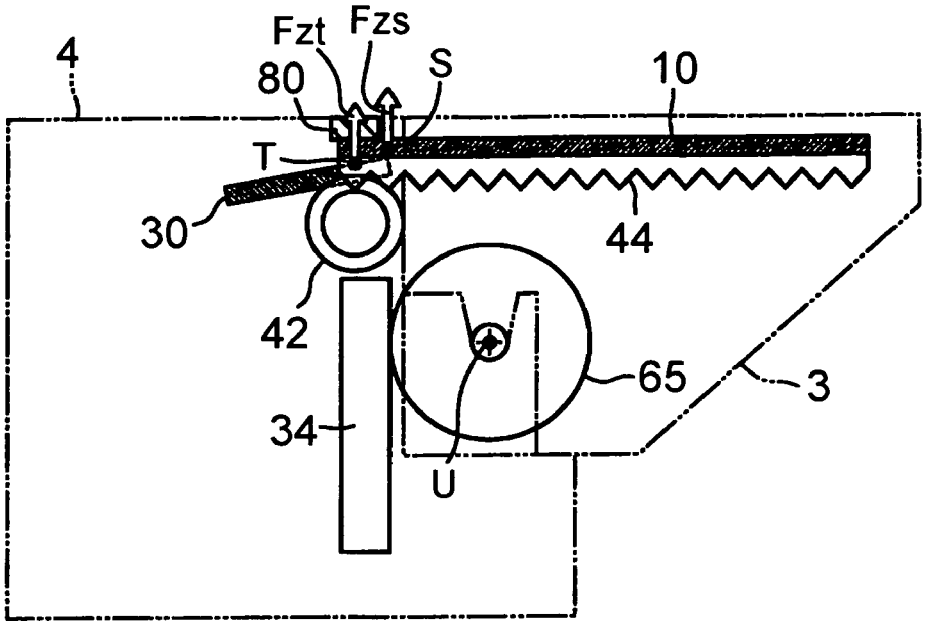
FIGS. 9A-9B are explanatory views of the force in the vertical direction, which acts on the movable blade and the cover unit, where
Figure 9B:
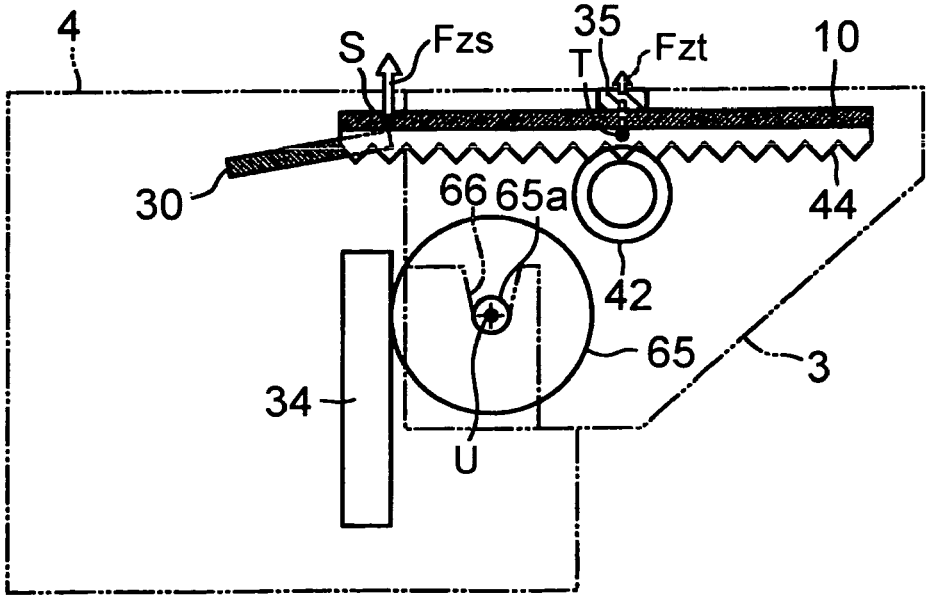
FIG. 9B PRIOR ART

FIG. 9 are explanatory views of the force in the vertical direction that acts on the movable blade and the cover unit, where FIG. 9A is a case of the pull-in method in this embodiment and FIG. 9B is a case of the push-out method in the related art.

In the related art technique illustrated in FIG. 9B, the pinion gear 42 is supported by the cover unit 3. Note that the fixed blade 30 is biased toward the movable blade 10 on the upper side, and the pressure contacting force is exerted on the movable blade 10. Further, the rack 44 receives a meshing reaction force in the vertical direction from the pinion gear 42. In order to prevent unmeshing of the rack 44 and the pinion gear 42 by the pressure contacting force and the meshing reaction force, a regulation member 35 for regulating the movement of the rack to the upper side is provided. The regulation member 35 is arranged on the opposite side of the pinion gear 42 with the rack 44 in between, and is supported by the cover unit 3 same as the pinion gear 42.

First, in the push-out method illustrated in FIG. 9B, the force in the vertical direction that acts on the movable blade 10 includes the meshing reaction force Fzt the rack 44 receives from the pinion gear 42 and the pressure contacting force Fzs the movable blade 10 receives from the fixed blade 30 biased to the upper side.

The meshing reaction force Fzt is received by the regulation member 35, and is canceled out in the cover unit 3 since the pinion gear 42 and the regulation member 35 are both supported by the cover unit 3. On the other hand, the movable blade 10 supported by the cover unit 3 receives the pressure contacting force Fzs from the fixed blade 30 supported by the main body unit 4 at the blade contacting portion S.

In this case, the cover unit 3 is connected to the main body unit 4 at the unit connecting portion U, and the pressure contacting force Fzs at the blade contacting portion S acts as the rotational moment in the clockwise direction with respect to the cover unit 3. Note that, because a slight play exists between the bottom surface of the cover unit 3 and the main body unit 4, the cover unit 3 slightly rotates in the direction of separating from the main body unit 4 in receiving the rotational moment. As a result, the movable blade 10 then separates from the fixed blade 30 in the vertical direction, whereby the pressure between the fixed blade 30 and the movable blade 10 lowers to cause a problem that the cutting operation becomes unstable, and the cutting performance lowers.

In contrast, In this embodiment illustrated in FIG. 9A, the pinion gear 42 is supported by the main body unit 4. In this embodiment as well, a regulation mechanism 80 for regulating the movement of the rack to the upper side is provided to prevent unmeshing of the rack 44 and the pinion gear 42. The regulation mechanism 80 is provided on the opposite side of the pinion gear 42 with the rack 44 in between, and is supported by the main body unit 4. Note that the regulation mechanism 80 may be provided on the cover unit 3. However, in this case, the regulation mechanism 80 is provided on the main body unit 4 same as the pinion gear 42. The structure of the regulation mechanism 80 is hereinafter described.

The force in the vertical direction that acts on the movable blade 10 in the pull-in method is the meshing reaction force Fzt the rack 44 receives from the pinion 42 and the pressure contacting force Fzs the movable blade 10 receives from the fixed blade 30 biased to the upper side.

The meshing reaction force Fzt is received by the regulation mechanism 80, and the pinion gear 42 and the regulation mechanism 80 are both supported by the main body unit 4. Therefore, the meshing reaction force is canceled out in the main body unit 4 The pressure contacting force Fzs is received by the regulation mechanism 80 from the fixed blade 30 via the movable blade 10, and the fixed blade 30 and the regulation mechanism 80 are both supported by the main body unit 4. Therefore, the pressure contacting force is canceled out in the main body unit 4.

Therefore, in the pull-in method illustrated in FIG. 9A, the force in the vertical direction is canceled out in the main body unit, the force and the rotational moment on the cover unit 3 do not act, the cutting operation of the cutter can be stabilized, and the cutting performance can be ensured.

(Meshing of Rack and Pinion Gear)

As illustrated in FIG. 7B, in this embodiment, the pinion gear 42 is supported by the main body unit 4. Thus, the rack 44 supported by the cover unit 3 and the pinion gear 42 supported by the main body unit 4 need to be smoothly meshed when re-coupling the cover unit 3 separated from the main body unit 4 to the main body unit 4.

Figure 10A:
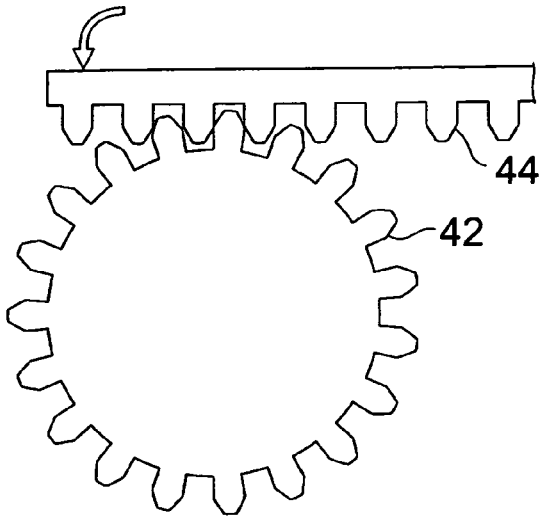
FIGS. 10A-10C are explanatory views of the meshing of the rack and the pinion gear.

FIG. 10 are explanatory views of the meshing of the rack and the pinion gear. As illustrated in FIG. 10A, the tooth shapes of the general rack 44 and the pinion gear 42 are involute shape. In this case as well, the rack 44 and the pinion gear 42 can be smoothly meshed by forming the tooth tops to tapered shapes.

Figure 10B:
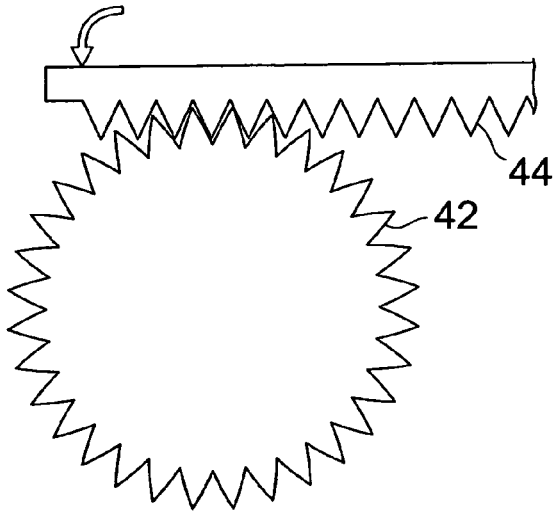

Further, as illustrated in FIG. 10B, the tooth shapes of the rack 44 and the pinion gear 42 may be triangular shape. In this case, the tooth tops are formed to sharp tapered shapes, and hence the rack 44 and the pinion gear 42 can be smoothly meshed with each other.

As described above, the tooth shapes of the rack 44 and the pinion gear 42 are shapes that enable the tooth tops of the rack 44 and the pinion gear 42 to mesh with each other without colliding when shifting the cover unit from the opened state to the closed state with respect to the main body unit.

Figure 10C:
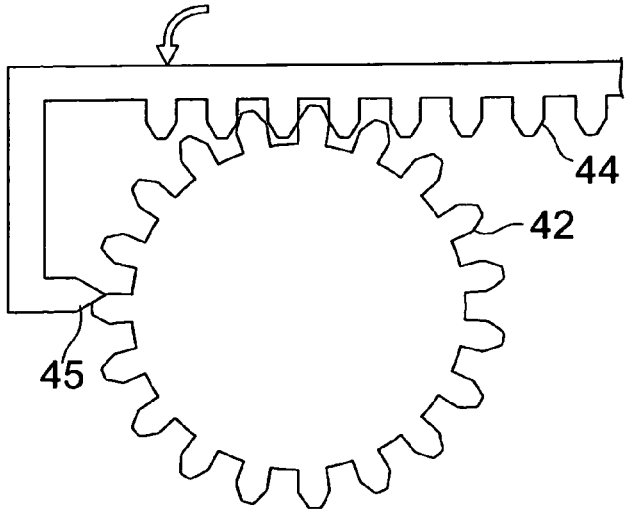

Further, as illustrated in FIG. 10C, the distal end of the rack 44 may be folded back toward the pinion gear 42 and a claw 45 may be provided at the distal end. When the rack 44 approaches the pinion gear 42 in shifting the cover unit from the opened state to the closed state with respect to the main body unit, the claw 45 contacts the teeth of the pinion gear 42 before the rack 44 meshes with the pinion gear 42 and rotates the pinion gear 42. In this case, by rotating the pinion gear 42 to a position where the rack 44 and the pinion gear 42 smoothly mesh with each other, the rack 44 and the pinion gear 42 can be smoothly meshed.

Further, by having the pinion gear rotatable in the state in which the cover unit 3 is separated, the rack 44 and the pinion gear 42 can be smoothly meshed when coupling the cover unit.

Figure 11A:
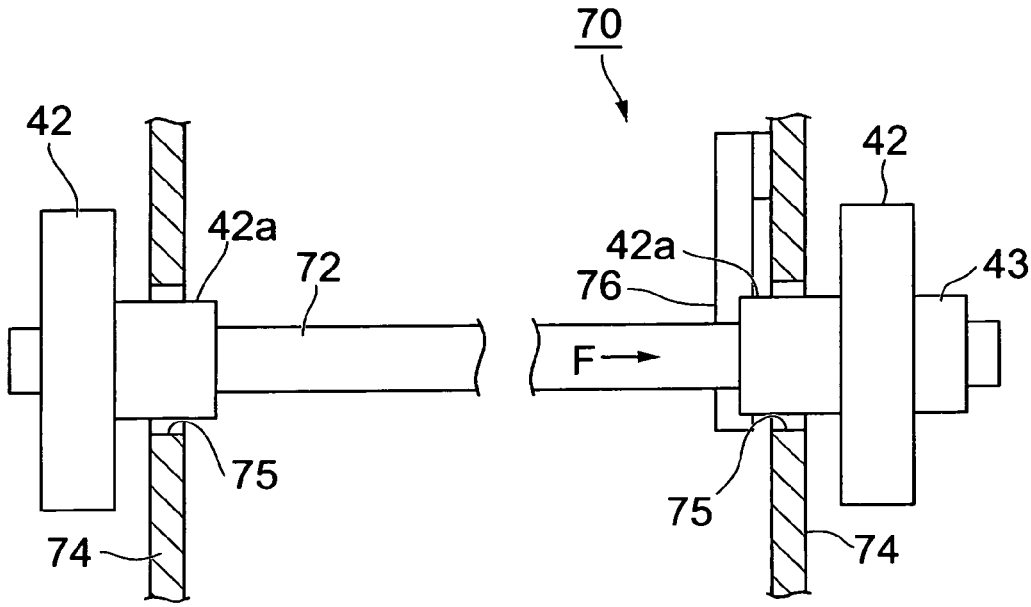
FIGS. 11A-11C are explanatory views of a pinion gear separation mechanism in the movable blade drive system.
Figure 11B:
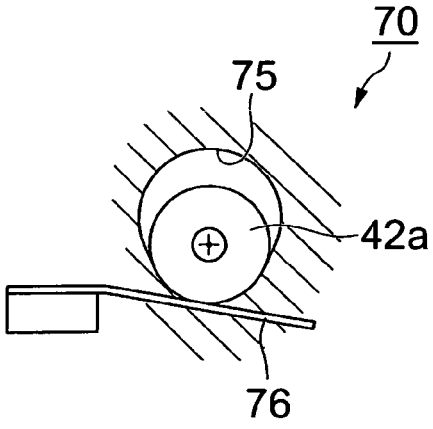
Figure 11C:
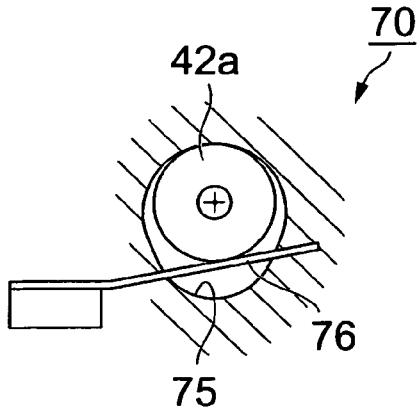

FIG. 11 are explanatory views of a pinion release mechanism. FIG. 11A is a view seen from the arrow E of FIG. 4, and FIG. 11B and FIG. 11C are views seen from the arrow F of FIG. 11A. As illustrated in FIG. 16B, since a pair of racks 44, 44 is provided on both sides in the width direction of the movable blade 10, a pair of pinion gears 42, 42 is provided on both sides in the width direction, as illustrated in FIG. 11A. The pair of pinion gears 42, 42 are connected by a shaft 72. Further, sleeves 42*a*, 42*a* are formed in a projecting manner from the pair of pinion gears 42, 42 toward the inner side. Note that a drive gear 43 that meshes with the gear train of the pinion drive system is provided on the outer side of one pinion gear 42. FIG. 11 are explanatory views of a pinion release mechanism. FIG. 11A is a view seen from the arrow E of FIG. 4, and FIG. 11B and FIG. 11C are views seen from the arrow F of FIG. 11A. As illustrated in FIG. 16B, since a pair of racks 44, 44 is provided on both sides in the width direction of the movable blade 10, a pair of pinion gears 42, 42 is provided on both sides in the width direction, as illustrated in FIG. 11A. The pinion gears 42, 42 are connected by a shaft 72. Further, sleeves 42*a*, 42*a* are formed in a projecting manner from the pair of pinion gears 42, 42 toward the inner side. Note that a drive gear 43 that meshes with the gear train of the pinion drive system is provided on the outer side of one pinion gear 42.

As illustrated in FIG. 11B, a vertically long through-hole 75 is formed in a frame 74 of the printer in the pinion release mechanism 70 of this embodiment. The sleeve 42*a* is inserted to the through-hole 75, and the pinion gear 42 is supported by the frame 74. A plate spring 76 for biasing the sleeve 42*a* to the upper side is provided below the through-hole 75.

When the cover unit 3 is coupled as illustrated in FIG. 7A, the pinion gear 42 is pushed down by the rack 44. In this case, the sleeve 42*a* is arranged on the lower side of the through-hole 75 against the biasing force of the plate spring 76, as illustrated in FIG. 11B. In contrast, when the cover unit is separated as illustrated in FIG. 7B, the pushing down of the pinion gear 42 by the rack 44 is resolved. In this case, the sleeve 42*a* is arranged on the upper side of the through-hole 75 by the biasing force of the plate spring 76, as illustrated in FIG. 11C.

In the state of FIG. 11C, the pinion gear 42 is rotatable since the gear train (see FIG. 4) arranged on the lower side of the drive gear 43 and the drive gear 43 are unmeshed. Thus, the rack 44 can rotate the pinion gear 42 when coupling the cover unit 3 to the main body unit 4. Therefore, the rack 44 and the pinion gear 42 can be smoothly meshed.

Note that the curvature radius at the lower side of the through-hole 75 illustrated in FIG. 11B is formed to be equal to the radius of the sleeve 42*a*, and the curvature radius at the upper side of the through-hole 75 is formed to be larger than the radius of the sleeve 42*a*. Thus, the pinion gear 42 is not only rotatable but is also movable upward, downward, to the left, and to the right when the sleeve 42*a* is arranged on the upper side of the through-hole 75. As a result, the rack 44 can rotate the pinion gear 42 while moving the same when coupling the cover unit 3 to the main body unit 4. Therefore, the rack 44 and the pinion gear 42 can be more smoothly meshed.

Note that as illustrated in FIG. 4, an idle gear 41*b* at the most downstream (closest to the pinion gear 42) of the pinion drive system 41 is arranged obliquely downward of the pinion gear 42. Thus, the pinion gear 42 pushed down by the rack 44 and the idle gear 41*b* can be smoothly meshed when coupling the cover unit 3 to the main body unit 4.

Further, in the pinion release mechanism 70 described above, the pinion gear 42 is lifted and made rotatable, but the pinion gear 42 may be made rotatable by detaching the idle gear 41*b* from the pinion drive system 41.

Further, in the embodiment described above, a case in which the pinion release mechanism 70 is provided to one pinion gear 42 has been described, but similar pinion release mechanism 70 may be provided with respect to both pinion gears 42, 42 and hence both pinion gears 42, 42 can be simultaneously lifted and made rotatable.

Note that, as in this embodiment illustrated in FIG. 4 and FIGS. 11A-11C, according to the configuration in which the pinion release mechanism 70 is provided only on one pinion gear 42 side provided with the drive gear 43 that meshes with the gear train of the pinion drive system, and the one pinion gear 42 provided with the pinion release mechanism 70 is positioned on the upper side with respect to the other pinion gear 42, the one pinion gear 42 provided with the drive gear 43 and one rack 44 corresponding thereto first mesh with each other, and the other pinion gear 42 and the other track 44 corresponding thereto mesh with each other following the first meshing when shifting the cover unit 3 from the opened state to the closed state with respect to the main body unit 4. Therefore, the rack 44 and the pinion gear 42 can be more smoothly and easily meshed.

(Regulation Mechanism)

Figure 12:
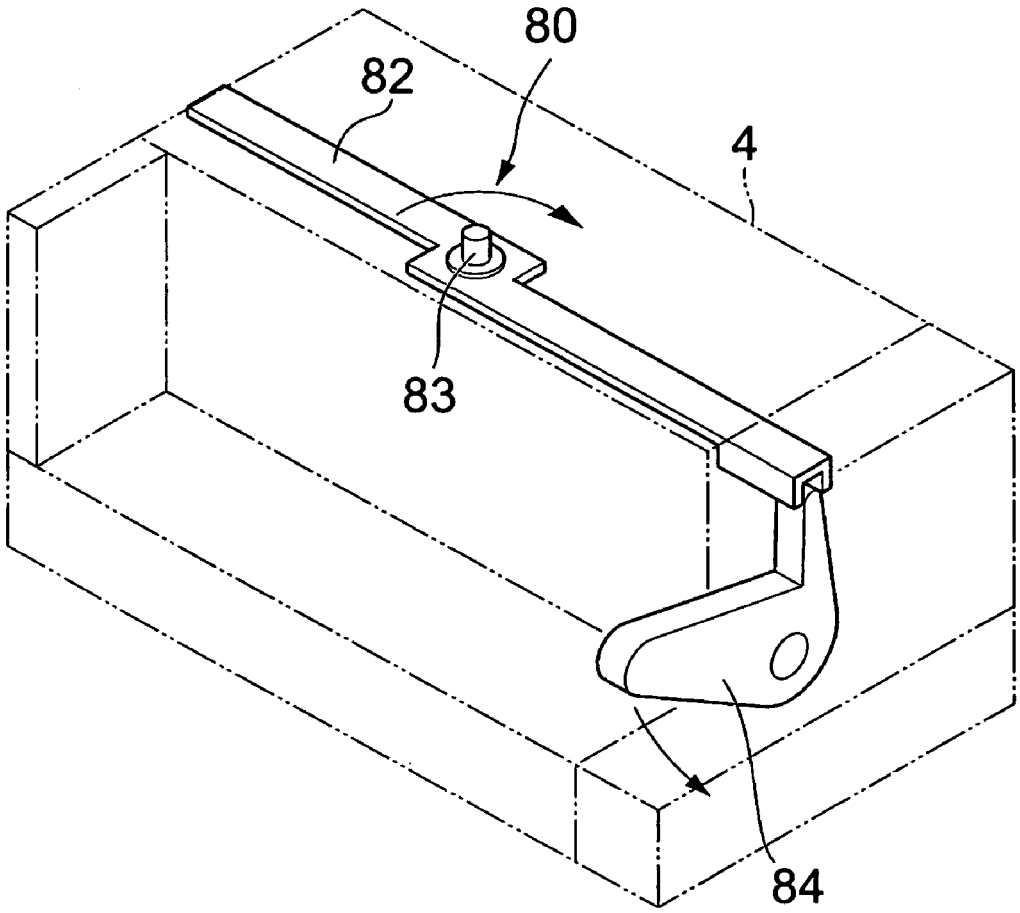
FIG. 12 is perspective views of a regulation mechanism.
Figure 13A:
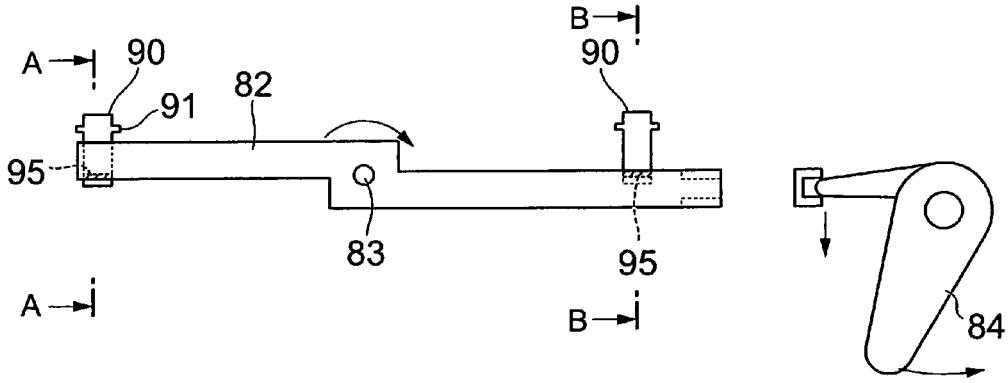
FIGS. 13A-13B are a plan view and a side view of the regulation mechanism.
Figure 13B:
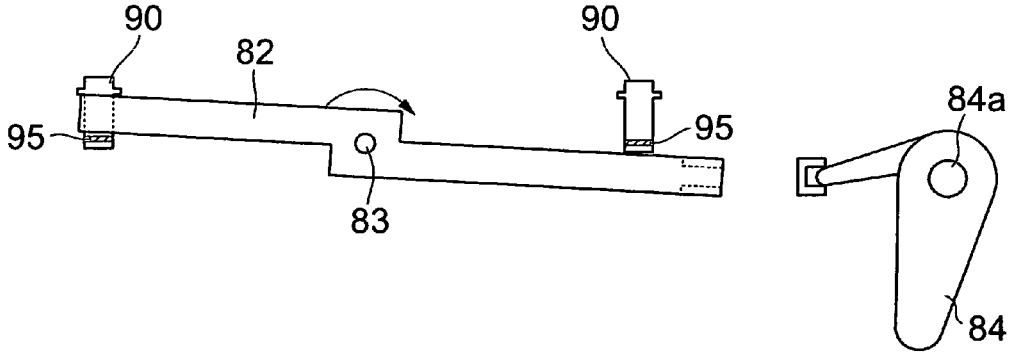
Figure 14A:
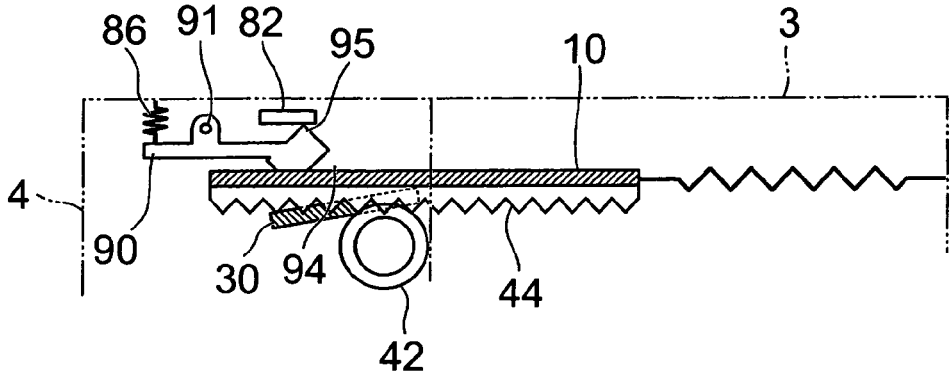
FIGS. 14A-14C are cross-sectional views at the portion corresponding to the line A-A of FIG. 13A.
Figure 14B:
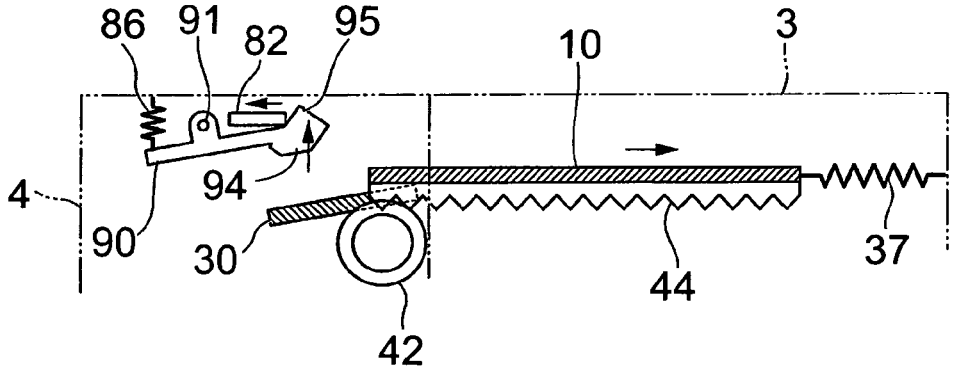
Figure 14C:
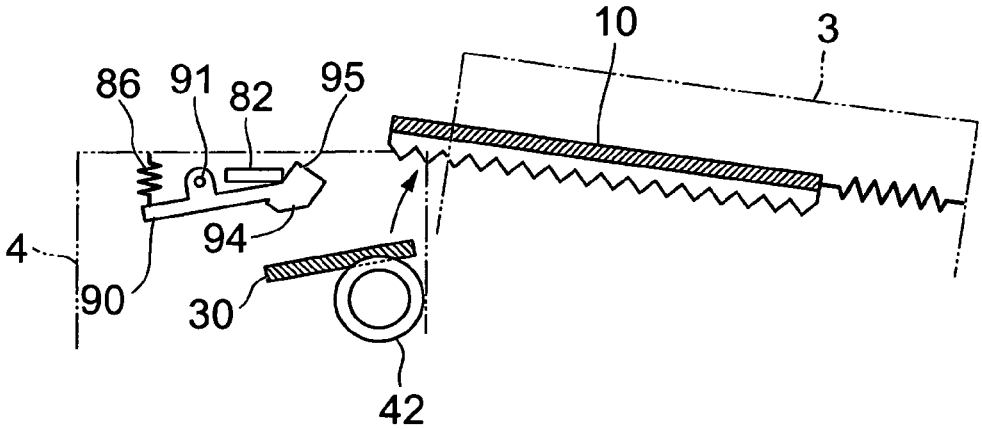

FIGS. 12 to 14 are explanatory views of the regulation mechanism. Note that FIG. 12 is a perspective view of the regulation mechanism, each figure of FIGS. 13A-13B is a plan view and a side view of the regulation mechanism, and FIG. 14A-14C are cross-sectional views at the portion corresponding to the line A-A of FIG. 13A. Further, FIGS. 15(*a*) to 15(*c*) are cross-sectional views at the portion corresponding to the line B-B of FIG. 13A.

As illustrated in FIG. 12, the regulation mechanism 80 is arranged on the main body unit 4, and includes a plate 82, a lever 84, and a regulation member 90 (see FIGS. 13A-13B). As illustrated in FIG. 12, the plate 82 is arranged on the upper surface of the main body unit 4, and is formed to a crank-shape in plan view. A rotation shaft 83 extending in the vertical direction is arranged at the center part of the plate 82, the plate 82 being formed to be rotatable about the rotation shaft 83. Meanwhile, the lever 84 is arranged at the side surface of the main body unit 4. The plate 82 can be rotated by pushing down the lever 84.

As illustrated in FIG. 13A, a regulation member 90 is arranged on the lower side at both ends of the plate 82. The regulation member 90 is formed to be rotatable about a rotation shaft 91 extending in the horizontal direction. The rotation shaft 91 is arranged parallel to the side surface of the plate 82 in plan view.

Figure 15A:
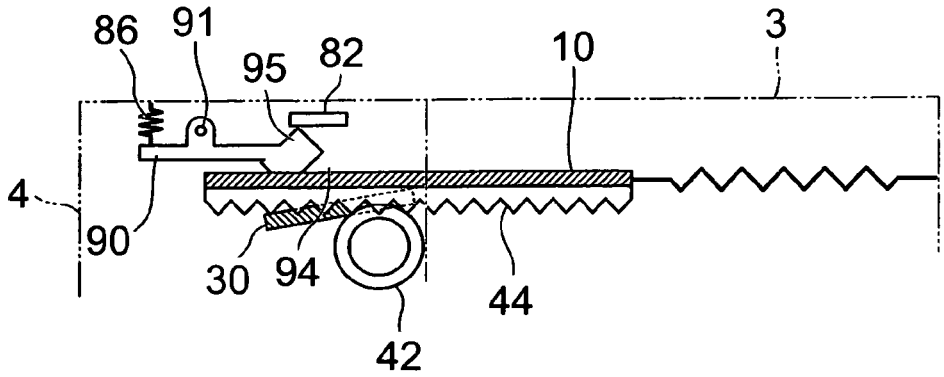
FIGS. 15A-15C are cross-sectional views at the portion corresponding to the line B-B of FIG. 13A.

As illustrated in FIG. 14A and FIG. 15A, a regulating portion 94 projecting to the lower side and an engagement portion 95 projecting to the upper side are formed at the end on the plate 82 side of the regulation member 90. The regulating portion 94 regulates the movement of the movable blade 10 to the upper side by contacting the movable blade 10 arranged below the regulation member 90, and the engagement portion 95 engages the lower surface of the plate 82. Meanwhile, an elastic body (coil spring) 86 for biasing the regulation member 90 in a direction in which the regulating portion 94 separates from the movable blade 10 is provided at the end of the regulation member 90 on the opposite side of the plate 82 with the rotation shaft 91 in between.

As illustrated in FIG. 13A when cutting the recording sheet, the engagement portion 95 of the regulation member 90 engages the lower surface of the plate 82. In this case, as illustrated in FIG. 14A and FIG. 15A the regulating portion 94 is contacting the movable blade 10 because the plate 82 pushes down the engagement portion 95 against the biasing force of the elastic body 86. The movable blade 10 thus can be regulated from moving to the upper side by the pressure contacting force from the fixed blade 30 to the movable blade 10, and detachment of the rack 44 from the pinion gear 42 can be prevented. As a result, the movable blade 10 can be smoothly moved by the driving force of the pinion gear 42. Further, the lowering in pressure between the movable blade 10 and the fixed blade 30 thus can be prevented, and the recording sheet can be reliably cut.

Figure 15B:
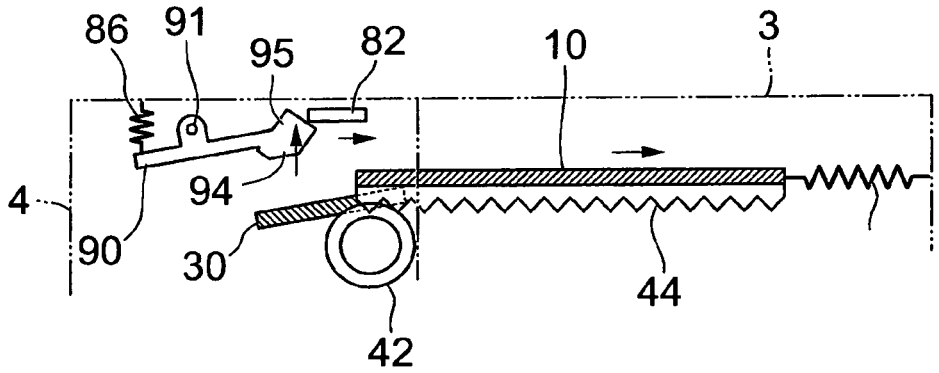
Figure 15C:
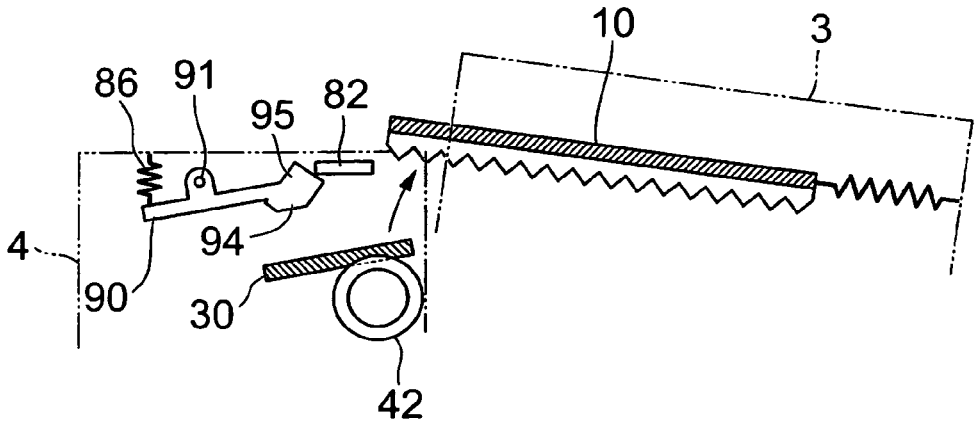

When the recording sheet is bitten between the fixed blade 30 and the movable blade 10, as illustrated in FIG. 13B, the lever 84 is pushed down to rotate the plate 82 thereby disengaging the lower surface of the plate 82 and the engagement portion 95 of the regulation member 90. In this case, as illustrated in FIG. 14B and FIG. 15B, the regulating portion 94 rises by the biasing force of the elastic body 86, and separates from the movable blade 10. The rack 44 thereby moves to the upper side, and the pinion gear 42 becomes rotatable by the biasing force of the plate spring 76 illustrated in FIG. 11C. As a result, as illustrated in FIG. 14B and FIG. 15B, the movable blade 10 returns to the home position by the restoring force of the elastic body 37. After that, as illustrated in FIG. 14C and FIG. 15C, the cover unit 3 fixed to the open/close door is opened to remove the recording sheet bitten between the fixed blade 30 and the movable blade 10. The cover unit 3 can be separated without the movable blade 10, the regulation member 90, and the plate 82 interfering because the movable blade 10 returns to the home position.

A torsion coil spring (not shown) is provided on a rotation shaft 84*a* of the lever 84 illustrated in FIG. 13B, and hence the lever 84 automatically returns to the state of FIG. 13A by stopping the push-down of the lever 84 and releasing the hand. In conjunction therewith, the plate 82 also returns to the state of FIG. 13A, the lower surface of the plate 82 and the engagement portion 95 of the regulation member 90 engage with each other, and the regulating portion of the regulation member 90 lowers.

Subsequently, when resuming the printing and the cutting of the recording sheet, the cover unit 3 is first closed as illustrated in FIG. 14B and FIG. 15B. The regulating portion 94 is then lowered as illustrated in FIG. 14A and FIG. 15A to regulate the movement of the movable blade 10 to the upper side. The driving force is thereby transmitted from the pinion gear 42 to the rack 44, and the movable blade 10 can be moved to cut the recording sheet.

Although the regulation mechanism 80 is arranged on the main body unit 4 side of FIG. 12 to FIG. 14, the regulation member 35 may be arranged on the cover unit 3 side as illustrated in FIG. 7A.

The main body unit 4 and the cover unit 3 are locked by the rotation shaft 65*b* of the platen roller 65, or locked when the lock shaft (not shown) installed on the cover unit 3 on the fixed blade 30 side with respect to the rotation shaft 65*b* is fitted to the lock groove (not shown) on the main body unit 4 side, and the regulation member 35 is arranged on the fixed blade 30 side with respect to the rotation shaft 65*b* of the cover unit 4.

In other words, with the coupling region (lock region) of the main body unit 4 and the cover unit 3 being formed in the vicinity of the pinion gear 42 and the fixed blade 30, the regulation member 35 is arranged on the fixed blade 30 side immediately above with respect to the coupling region of the main body unit 4 and the cover unit 3.

The upward pressure contacting force Fzs which the movable blade 10 receives from the fixed blade 30 and the upward meshing reaction force Fzt which the rack 44 receives from the pinion gear 42 illustrated in FIG. 9A are exerted on the regulation member 35 supported by the cover unit 3 in FIG. 7A. Most of such forces can be received at the coupling region (lock region) by adopting the above-mentioned arrangement, and thus the rotational moment having the coupling region (lock region) as the center that acts on the cover unit 4 can be minimized.

The regulation member 35 may be configured simply by a rigid body. Thus, as illustrated in FIG. 7A, the movement of the movable blade 10 to the upper side can be regulated by the regulation member 35 by merely coupling the cover unit 3 to the main body unit 4. Further, as illustrated in FIG. 7B, the movement of the movable blade 10, which is regulated by the regulation member 35, can be deregulated by merely separating the cover unit from the main body unit 4. Therefore, a complex mechanism for regulating the movement of the movable blade 10 is unnecessary, and the manufacturing cost can be reduced.

(Movable Blade Socket)

The thermal printer 1 includes a movable blade socket (supporting unit) with which the movable blade 10 can be replaced.

Figure 16A:
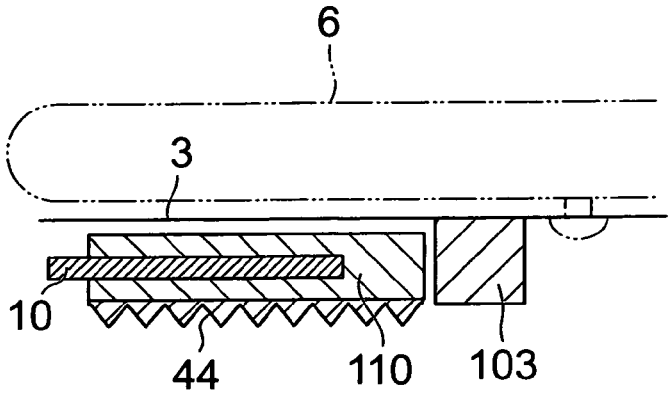
FIGS. 16A-16B are explanatory views of a movable blade socket.
Figure 16B:
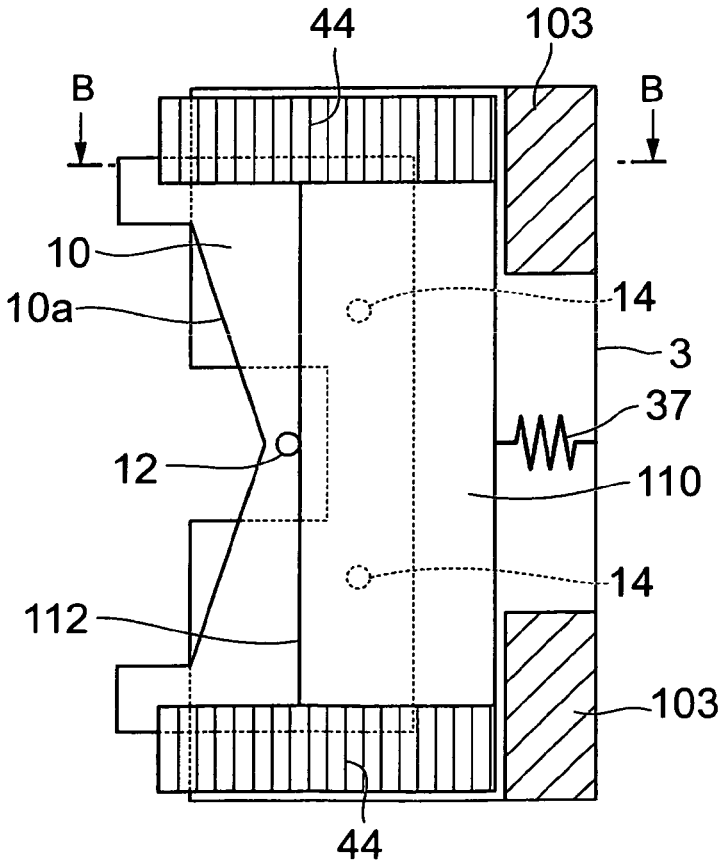
Figure 17A:
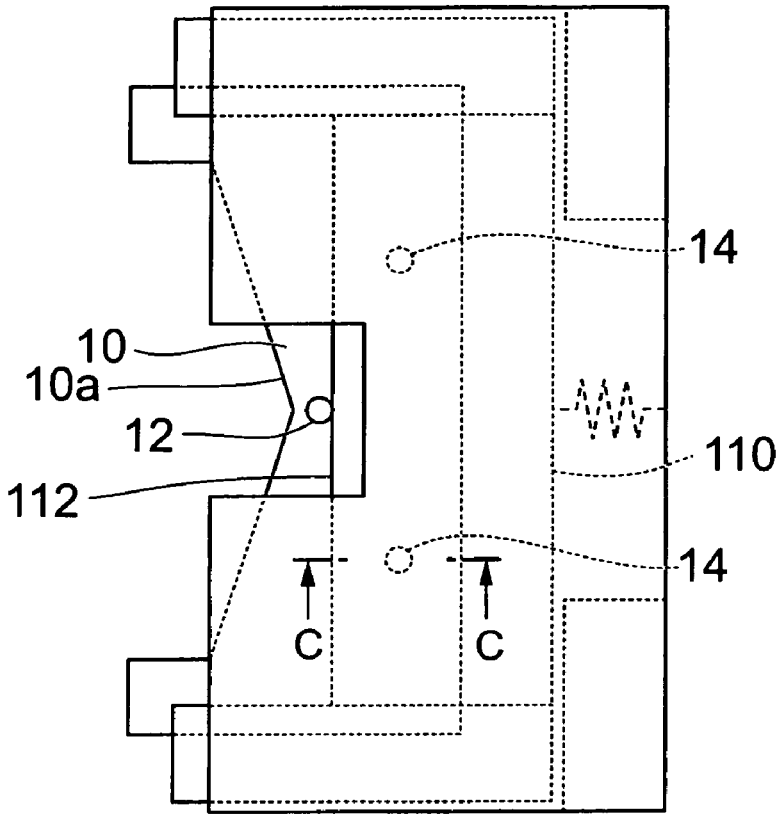
FIGS. 17A-17B are explanatory views of the movable blade socket.
Figure 17B:
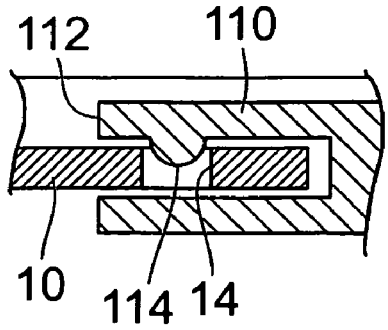

FIG. 16 and FIG. 17 are explanatory views of the movable blade socket. FIG. 16A is a side cross-sectional view taken along the line B-B of FIG. 16B, and FIG. 16B is a bottom view. FIG. 17A is a plan view, and FIG. 17B is a partial cross-sectional view taken along the line C-C of FIG. 17A.

As illustrated in FIG. 16A, the cover unit 3 is provided below the open/close door 6, and the movable blade socket 110 is provided in the interior of the cover unit 3. The movable blade socket 110 is made of resin material and the like, is formed to a box-shape with one surface opened, and is able to interiorly accommodate the movable blade 10. As illustrated in FIG. 16A and FIG. 15B, a cutout 112 for exposing the cutting edge 10*a* of the movable blade 10 is provided on the upper surface and the lower surface of the movable blade socket 110.

As illustrated in FIG. 16B, a stopper 103 is arranged on the opposite side of the fixed blade (not shown) with the movable blade socket 110 in between. The elastic body 37 for biasing the movable blade socket 110 toward the stopper 103 is also provided. The movable blade 10 is arranged at the home position when the movable blade socket 110 contacts the stopper 103. The rack 44 is formed on both sides in the width direction of the bottom surface of the movable blade socket 110.

As illustrated in FIG. 17A, a pair of fixation holes 14 is provided on the proximal end side of the movable blade 10. As illustrated in FIG. 17B, a pair of projections 114 is formed on the inner surface of the movable blade socket 110. The movable bade 10 is fixed to the movable blade socket 110 when each projection 114 engages each fixation hole 14, with the movable blade 10 being accommodated inside the movable blade socket 110.

As illustrated in FIG. 17A, a replacement hole 12 is provided on the distal end (cutting edge 10*a*) side of the movable blade 10. The replacement hole 12 is exposed from the cutout 112 formed on the upper surface and the lower surface of the movable blade socket 110. A movable blade replacement jig having a hook at the distal end is prepared, and the hook is inserted to the replacement hole 12 so that the movable blade 10 is pulled to the opening side of the movable blade socket 110. The projection 114 and the fixation hole 14 illustrated in FIG. 17B are thereby disengaged, and the movable blade 10 can be pulled out from the movable blade socket 110.

After that, a different movable blade 10 is inserted and fixed to the movable blade socket 110, and the replacement of the movable blade 10 is completed.

The movable blade 10 is replaced when changing the type of the movable blade 10 other than when discarding the movable blade 10 which cutting edge 10*a* has degraded.

Figure 18A:
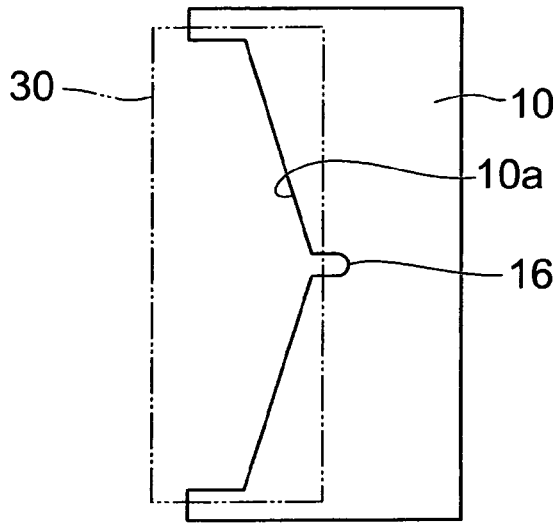
FIGS. 18A-18B are plan views of the movable blade for cutting the recording sheet while leaving the connecting points.
Figure 18B:
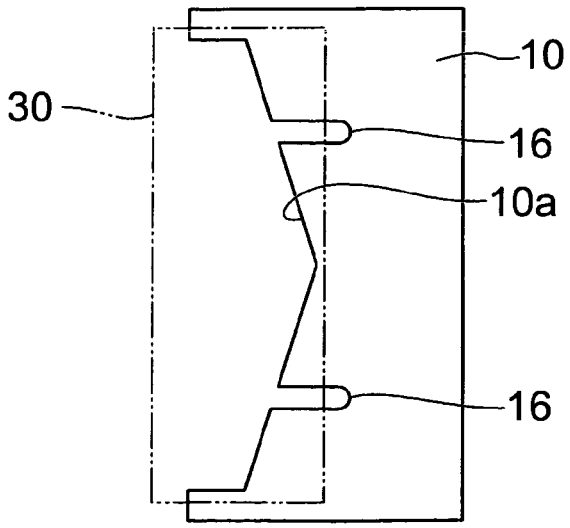

FIG. 18 are plan views of the movable blade for cutting the recording sheet while leaving the connecting points, where FIG. 18A is a movable blade for leaving one point and FIG. 18B is a movable blade for leaving two points. The movable blade 10 illustrated in FIG. 18A includes a cutout 16 at a central valley portion of the V-shaped cutting edge 10*a*. When the movable blade 10 is moved so that the fixed blade 30 overlaps up to the middle of the cutout 16, the recording sheet is not cut at the portion of the cutout 16, and the recording sheet is cut at other portions. The recording sheet thus can be cut leaving one connecting point at the central part in the width direction. The movable blade 10 illustrated in FIG. 18B includes the cutouts 16, 16 at a central part of the inclined side of the V-shaped cutting edge 10*a*. When the movable blade 10 is moved so that the fixed blade 30 overlaps up to the middle of the cutouts 16, 16 beyond the central valley portion of the cutting edge 10*a*, the recording sheet can be cut while leaving two connecting points. The scattering of the recording sheet discharged from the printer can be prevented by leaving the connecting point. The connecting point can be easily broken to separate the recording sheet by simply pulling the discharged recording sheet.

In the techniques disclosed in Patent Documents 1 and 2, it is impossible to replace only the movable blade, and the whole movable blade unit including the platen roller and the pinion gear needs to be replaced, and thus the waste in replacing the movable blade is large.

In this embodiment, on the other hand, the pinion gear 42 is mounted to the main body unit 4 as illustrated in FIG. 4, and thus a simple structure in which only the movable blade 10 and the platen roller 65 are mounted to the cover unit 3 is obtained. Thus, only the movable blade 10 can be replaced without replacing the pinion gear 42 and the pinion drive system 41, and the waste in replacement can be eliminated.

The technical scope of the present invention is not limited to the above-mentioned embodiments, and various modifications may be made to the above-mentioned embodiments without departing from the gist of the present invention. In other words, the specific material and layer configuration described in the embodiment are merely examples, and may be appropriately changed.

For instance, while the thermal printer has been described as an example of the printer with cutter in each embodiment, this should not be construed restrictively. For instance, an inkjet printer for printing the pulled out recording sheet using ink droplets, with the thermal head as the inkjet head, may be adopted.

The thermal printer having the open/close door provided on the upper surface of the casing has been described. However, the open/close door may be provided on the front surface of the casing and the printed recording sheet may be discharged from the front surface side. The thermal printer of drop-in type in which the roll sheet is inserted and simply placed on the mounting board has been described. However, instead of such type, a pivot supporting type thermal printer in which a pivot supporting mechanism for pivotally supporting (rotatably supporting) the roll sheet inside the casing is provided may be adopted.

What is claimed is:

1. A printer comprising:

a main body unit which supports one of a thermal head and a platen roller and one of a movable blade constructed integrally with a rack and a fixed blade;

a cover unit which supports another of the thermal head and the platen roller, and another of the movable blade and the fixed blade; and a movable blade drive mechanism for driving the movable blade and a platen drive mechanism for driving the platen roller, wherein:

a pinion gear rotated by the movable blade drive mechanism is provided on a unit different from the unit supporting the movable blade;

the cover unit is provided to be freely openable/closable with respect to the main body unit; and, when the cover unit is closed with respect to the main body unit, the pinion gear meshes with the rack and reciprocates the movable blade so that the movable blade and the fixed blade cooperate to cut a recording sheet at a predetermined position.

2. A printer according to claim 1, further comprising a pinion gear release mechanism for enabling the pinion gear to freely rotate.

3. A printer according to claim 1, wherein:

the pinion gear comprises a pair of pinion gears respectively provided on left and right with respect to one axis;

the rack constructed integrally with the movable blade arranged on the cover unit meshes with the pinion gear on the movable blade drive mechanism side and then meshes with the another pinion gear, and thereafter, the pinion gear on the movable blade drive mechanism side and the movable blade drive mechanism mesh with each other when the cover unit is closed with respect to the main body unit.

4. A printer according to claim 1, wherein the rack and the pinion gear have tooth shapes in which tooth tops mesh with each other without locking when shifting the cover unit from an opened state to a closed state with respect to the main body unit.

5. A printer according to claim 1, wherein the rack comprises with a claw for rotating the pinion gear before the pinion gear meshes with the rack when shifting the cover unit from the opened state to the closed state with respect to the main body unit.

6. A printer according to claim 1, wherein:

the rack comprises a regulation member for regulating the rack not to be detached from the pinion gear; and the regulation member is supported by an arrangement unit of the fixed blade.

7. A printer according to claim 1, wherein:

the rack comprises a regulation member for regulating the rack not to be detached from the pinion gear; and the regulation member is supported by an arrangement unit of the movable blade.

8. A printer according to claim 1, wherein:

the rack comprises a regulation member for regulating the rack not to be detached from the pinion gear; and the regulation member is arranged on the fixed blade side with respect to a rotation shaft of the platen roller.

9. A printer according to claim 1, wherein the movable blade is removable with respect to the supporting unit so as to be replaceable.

10. A printer comprising:

a main body unit which supports a thermal head and a fixed blade;

a cover unit which supports a platen roller and a movable blade constructed integrally with a rack; and a movable blade drive mechanism for driving the movable blade and a platen drive mechanism for driving the platen roller which are provided in the main body unit; wherein:

a pinion gear rotated by the movable blade drive mechanism is provided in the main body unit;

the cover unit is provided to be freely openable/closable with respect to the main body unit; and, when the cover unit is closed with respect to the main body unit, the pinion gear meshes with the rack and reciprocates the movable blade so that the movable blade and the fixed blade cooperate to cut a recording sheet at a predetermined position.

11. A printer according to claim 10, further comprising a pinion gear release mechanism for enabling the pinion gear to freely rotate.

12. A printer according to claim 10, wherein:

the pinion gear comprises a pair of pinion gears respectively provided on left and right with respect to one axis;

the rack constructed integrally with the movable blade arranged on the cover unit meshes with the pinion gear on the movable blade drive mechanism side and then meshes with the another pinion gear, and thereafter, the pinion gear on the movable blade drive mechanism side and the movable blade drive mechanism mesh with each other when the cover unit is closed with respect to the main body unit.

13. A printer according to claim 10, wherein the rack and the pinion gear have tooth shapes in which tooth tops mesh with each other without locking when shifting the cover unit from an opened state to a closed state with respect to the main body unit.

14. A printer according to claim 10, wherein the rack comprises a claw for rotating the pinion gear before the pinion gear meshes with the rack when shifting the cover unit from the opened state to the closed state with respect to the main body unit.

15. A printer according to claim 10, wherein:

the rack comprises a regulation member for regulating the rack not to be detached from the pinion gear; and the regulation member is supported by an arrangement unit of the fixed blade.

16. A printer according to claim 10, wherein:

the rack comprises a regulation member for regulating the rack not to be detached from the pinion gear; and the regulation member is supported by an arrangement unit of the movable blade.

17. A printer according to claim 10, wherein:

the rack comprises a regulation member for regulating the rack not to be detached from the pinion gear; and the regulation member is arranged on the fixed blade side with respect to a rotation shaft of the platen roller.

18. A printer according to claim 10, wherein the movable blade is removable with respect to the supporting unit so as to be replaceable.

* * * * *